US007368230B2

(12) United States Patent
Hosokawa et al.

(10) Patent No.: US 7,368,230 B2
(45) Date of Patent: May 6, 2008

(54) SILVER HALIDE PHOTOGRAPHIC MATERIAL AND IMAGE-FORMING METHOD USING THE SAME

(75) Inventors: Junichiro Hosokawa, Minami-Ashigara (JP); Masaaki Miki, Minami-Ashigara (JP); Yoichi Hosoya, Minami-Ashigara (JP); Kouichi Yokota, Minami-Ashigara (JP); Ryoji Nishimura, Minami-Ashigara (JP); Hideyuki Shirai, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/705,141

(22) Filed: Feb. 12, 2007

(65) Prior Publication Data

US 2007/0190467 A1 Aug. 16, 2007

(30) Foreign Application Priority Data

| | | | |
|---|---|---|---|
| Feb. 13, 2006 | (JP) | ..... | 2006-035533 |
| Mar. 31, 2006 | (JP) | ..... | 2006-100173 |
| Jun. 2, 2006 | (JP) | ..... | 2006-154924 |
| Jul. 28, 2006 | (JP) | ..... | 2006-206958 |

(51) Int. Cl.

| | |
|---|---|
| ***G03C 1/46*** | (2006.01) |
| ***G03C 1/06*** | (2006.01) |
| ***G03C 1/815*** | (2006.01) |
| ***G03C 1/825*** | (2006.01) |
| ***G03C 1/08*** | (2006.01) |

(52) U.S. Cl. ..... 430/506; 430/502; 430/503; 430/504; 430/505; 430/567; 430/517; 430/559

(58) Field of Classification Search ..... 430/502–506, 430/517, 559, 567

See application file for complete search history.

(56) References Cited

U.S. PATENT DOCUMENTS

| | | | | |
|---|---|---|---|---|
| 5,399,469 | A | 3/1995 | Szajewski | |
| 7,026,107 | B2 * | 4/2006 | Shirai | 430/502 |
| 2004/0142248 | A1 | 7/2004 | Kokeguchi | |
| 2005/0142504 | A1 | 6/2005 | Shirai | |

FOREIGN PATENT DOCUMENTS

| | | | |
|---|---|---|---|
| JP | 7-128790 | A | 5/1995 |
| JP | 7-128791 | A | 5/1995 |
| JP | 10-20461 | A | 1/1998 |

* cited by examiner

*Primary Examiner*—Geraldina Visconti
(74) *Attorney, Agent, or Firm*—Birch, Stewart, Kolasch & Birch, LLP

(57) ABSTRACT

An image-forming method of recording a digital image data in resolution of 2,000 dpi or more, the method comprising: recording a digital image data on a silver halide photographic material with little deterioration.

9 Claims, 1 Drawing Sheet

SILVER HALIDE PHOTOGRAPHIC MATERIAL AND IMAGE-FORMING METHOD USING THE SAME

BACKGROUND OF THE INVENTION

1. Field of the Invention

The present invention relates to an image-forming method using a silver halide photographic material, specifically relates to an image-forming method of recording a digital data on a silver halide photographic material with little deterioration. More specifically the invention relates to a silver halide photographic material capable of realizing the image-forming method.

2. Description of the Related Art

In the manufacture of a motion picture, a method of making a duplicate by printing on an intermediate film an image data photographed by using a negative film for photography as the original image, and further printing the duplicate on a positive film for motion picture to use it for projection has been conventionally used.

In many cases, an intermediate film for the manufacture of a duplicate is used two times. An original negative film is printed on a negative type intermediate film to make a master positive film. The master positive film is then again printed on an intermediate film to make a duplicate negative film. Lastly the duplicate negative film is printed on a positive film for motion picture to manufacture a print for screening.

In recent years in the manufacture of motion pictures, a method of converting an original image to a film as an analog image with a film recorder by digital synthesis and edition is rapidly prevailing. This is for the reason that by creating an image that is impossible in the actual world by synthesis and edition with the computer, the degree of freedom of presentation by image can be enlarged. Various images can be used as original images, for example, image data obtained by digitizing the image data photographed with a negative film for photography with a film scanner, image data photographed with an HD video camera, image data obtained by computer graphics and the like.

As the number of pixels of an original image, for example, when a negative film for photography is digitized with a film scanner to make an image data of 2,048×1,556, the number of pixels is 3,190,000 pixels.

When an original image is conveniently made into a digital data and screened by conventional analog projection as described above, such processes are taken as to print the original made as a digital data on an intermediate film and then print this duplicate on a positive film for motion picture similarly to the conventional method.

However, when such a method is used, a problem has newly arisen with the increase of resolution of digital data. When an original image is printed on a silver halide photographic material, the image quality is deteriorated and sufficient image quality for screening cannot be secured. There are problems of the improvement of the deterioration of image qualities ascribable to photographic characteristics of analog silver halide photographic materials, such as the occurrence of blotting, the deterioration of sharpness, and the reduction of color reproduction. JP-A-10-20461 (the term "JP-A" as used herein refers to an "unexamined published Japanese patent application") discloses a silver halide photographic material that is characterized in that the N value of a magenta image by laser scanning exposure is from 100 to 200 μm. The N value is the amount corresponding to the blotting of an image, which patent discloses the decrement of blotting of letters in printing on color photographic paper. However, the size of a pixel is 12 μm or smaller in resolution of 2,000 dpi or more used in recent years in the field of the manufacture of motion picture, so that such an N value is apparently inappropriate in resolving a precise image data. Accordingly, it has been strongly desired to develop a method capable of recording a digital data on a silver halide photographic material with little deterioration.

Blotting and sharpness can be improved by the prevention of light scattering. It has been thought that the greater the surface area of silver halide grains of the constituent of photographic material, the greater is light scattering, such as tabular grains having a greater surface area. For example, JP-A-7-128791 discloses a technique and examples to improve sharpness by containing a fixed magenta dye in a layer on the further side from the support than a green-sensitive layer containing tabular silver halide grains.

As described above, conventional intermediate films are used for duplication by printing thereon an original image that is an image data photographed by using a negative film for photography, so that it is sufficient for conventional intermediate films to use fine silver halide grains having an average equivalent-sphere diameter of 0.35 μm or less that is almost free from light scattering and capable of highly precise recording.

However, when a digital data highly increased in resolution that is different from conventional use is recorded, occurrence of blotting, reduction of sharpness, and deterioration of color reproduction are conspicuous, so that conventional intermediate films are insufficient in recording precise images.

Accordingly, a silver halide photographic material capable of recording a digital data with little deterioration, that is, a silver halide photographic material capable of preventing occurrence of blotting, reduction of sharpness and deterioration of color reproduction, and capable of recording a digital data is strongly desired.

Further, a new problem arose at the time of recording a digital image data on a photographic material with a film recorder. In general, when a digital image data is recorded on a photographic material with a film recorder, for the purpose of determining the exposure conditions, a standard image is recorded in advance on a film on proper exposure conditions, developed, and the density is measured, and after the exposure amount is calibrated on the basis of the result of measurement of density, an original image is recorded appropriately. Accordingly, the deviation of the tint of image occurs by the fluctuation of the photographic properties in the development processing of the film used. Therefore, a silver halide photographic material little in fluctuation of development processing is strongly desired.

SUMMARY OF THE INVENTION

An object of the invention is to provide a method capable of recording a digital data on a silver halide photographic material with high resolution and little deterioration. Another object is to provide a silver halide photographic material capable of realizing such an image-forming method with little deterioration and excellent in development processing properties.

The terminology of "recording with little deterioration" in the invention means to suppress vanishing of the image structure contained in a digital image data at the time of recording as far as possible and suppressing the fluctuation of color data at the time of recording as far as possible.

As a result of eager investigations by the present inventors for solving the above problems, it has been found that a photographic material with little blotting, not accompanied by the deterioration of sharpness and color reproduction can be obtained by the use of a fixed dye of the invention in recording a highly precise digital data.

That is, the constitutions of the invention are as follows.

(1) An image-forming method of recording a digital image data in resolution of 2,000 dpi or more, the method comprising: recording a digital image data on a silver halide photographic material with little deterioration.

(2) An image-forming method of recording a digital image data of 3,000,000 pixels or more, the method comprising: recording a digital image data on a silver halide photographic material with little deterioration.

(3) The image-forming method as described in (1) or (2) above, wherein blotting k of an image based on the digital image data recorded at the image recording satisfies expression (I):

$$k \leqq 7.5\ \mu m \times (D-0.2)^2 \quad \text{(I)}$$

wherein D is a coloring density of the silver halide photographic material; and blotting k is a blotting (μm) in a coloring density D.

(4) The image-forming method as described in (1) or (2) above, wherein blotting k of an image based on the digital image data recorded at the image recording satisfies expression (I-4):

$$k \leqq 4.5\ \mu m \times (D-0.2)^2 \quad \text{(I-4)}$$

wherein D is a coloring density of the silver halide photographic material; and blotting k is a blotting (μm) in a coloring density D.

(5) The image-forming method as described in any of (1) to (4) above, wherein a color purity rate in color reproduction of an image based on the digital image data recorded at the image recording is 80% or more.

(6) An image-forming method, which comprises: recording a digital image data which is recorded by a method as described in any of (1) to (5) above on another silver halide photographic material by an analog method.

(7) A silver halide photographic material, which comprises:

a transparent support; and a plurality of layers comprising a first layer, a second layer and a third layer on the transparent support, wherein the first layer consists of at least one blue-sensitive silver halide emulsion layer, the second layer consists of at least one green-sensitive silver halide emulsion layer and the third layer consists of at least one red-sensitive silver halide emulsion layer, wherein the silver halide photographic material comprises at least one layer containing a fixed magenta dye which is located as at least one of: a layer on the opposite side to the transparent support with the at least one green-sensitive silver halide emulsion layer as a center and not the at least one green-sensitive silver halide emulsion layer; and a layer on the side of the transparent support with the at least one green-sensitive silver halide emulsion layer as a center and not the at least one green-sensitive silver halide emulsion layer.

(8) A silver halide photographic material, which comprises:

a transparent support; and a plurality of layers comprising a first layer, a second layer and a third layer on the transparent support, wherein the first layer consists of at least one blue-sensitive silver halide emulsion layer, the second layer consists of at least one green-sensitive silver halide emulsion layer and the third layer consists of at least one red-sensitive silver halide emulsion layer, wherein the silver halide photographic material comprises at least one layer containing a fixed cyan dye which is located as a layer on the opposite side to the transparent support with the at least one red-sensitive silver halide emulsion layer as a center and not the at least one red-sensitive silver halide emulsion layer.

(9) The silver halide photographic material as described in (8) above, wherein the silver halide photographic material comprises at least one layer containing a fixed magenta dye which is located as at least one of: a layer on the opposite side to the transparent support with the at least one green-sensitive silver halide emulsion layer as a center and not the at least one green-sensitive silver halide emulsion layer; and a layer on the side of the transparent support with the at least one green-sensitive silver halide emulsion layer as a center and not the at least one green-sensitive silver halide emulsion layer.

(10) The silver halide photographic material as described in any of (7) to (9) above, wherein at a time of recording a digital image data in resolution of 2,000 dpi or more, the digital image data can be recorded with little deterioration.

(11) The silver halide photographic material as described in any of (7) to (9) above, wherein a digital image data of 3,000,000 pixels or more can be recorded with little deterioration.

(12) The silver halide photographic material as described in any of (7) to (11) above, wherein blotting k of an image based on the digital image data recorded at the image recording satisfies expression (I):

$$k \leqq 7.5\ \mu m \times (D-0.2)^2 \quad \text{(I)}$$

wherein D is a coloring density of the silver halide photographic material; and blotting k is a blotting (μm) in a coloring density D.

(13) The silver halide photographic material as described in any of (7) to (11) above, wherein blotting k of an image based on the digital image data recorded at the image recording satisfies expression (I-4):

$$k \leqq 4.5\ \mu m \times (D-0.2)^2 \quad \text{(I-4)}$$

wherein D is a coloring density of the silver halide photographic material; and blotting k is a blotting (μm) in a coloring density D.

(14) The silver halide photographic material as described in any of (7) to (13) above, wherein a color purity rate in color reproduction of an image based on the digital image data recorded at the image recording is 80% or more.

(15) An image-forming method, which comprises: recording a digital image data which is recorded on a silver halide photographic material as described in any of (7) to (14) above on another silver halide photographic material by an analog method.

DETAILED DESCRIPTION OF THE INVENTION

Figure 1:
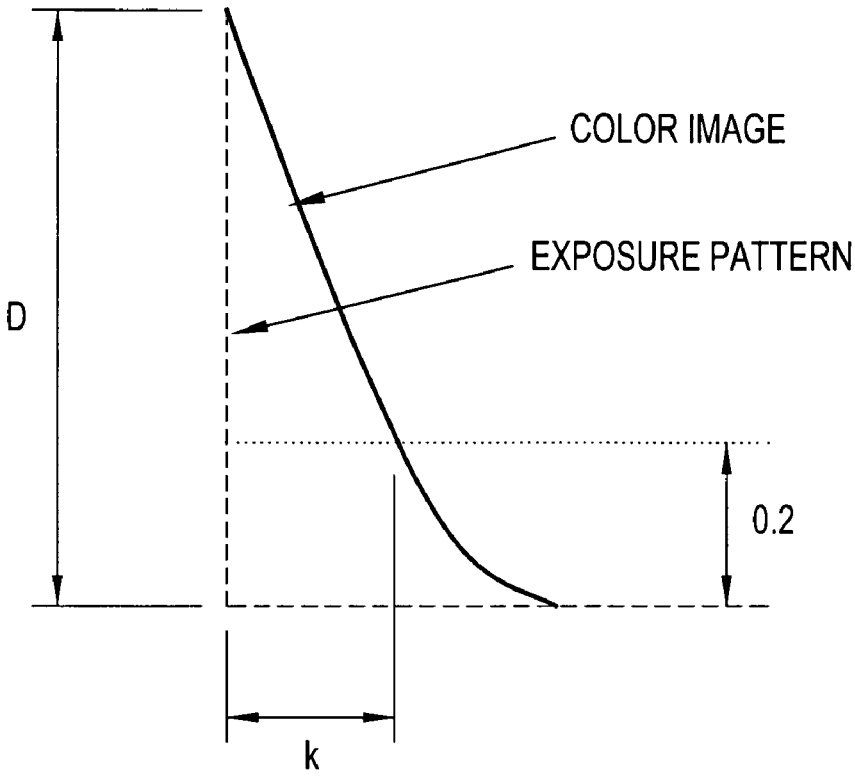
FIG. 1 is a drawing showing the relationship between coloring density D and blotting k of a silver halide photographic material, wherein D denotes coloring density of a silver halide photographic material; and k denotes blotting in coloring density D.

The invention will be described in detail below.

The digital image data in the invention are explained. The digital image data in the invention are image data obtained by digitizing the image data photographed with a negative film for photography with a film scanner, image data photographed with an HD video camera, image data obtained by computer graphics and the like.

In the next place, the number of pixels in the invention is described. The number of pixels in the invention means the total number of pixels contained in the digital image data in the invention for use at the time of recording on a silver halide photographic material. For example, when a negative film for photography is digitized with a film scanner to make an image data of 2,048×1,556, the number of pixels is 3,190,000 pixels.

Evaluating Method of Blotting:

In the invention, to perform recording with little deterioration, it is preferred that blotting k of an image at the time of image recording satisfies the following expression (I):

$$k \leqq 7.5\ \mu m \times (D-0.2)^2 \quad \text{(I)}$$

In expression (I), D is the coloring density of the silver halide photographic material, and blotting k is the blotting (μm) in coloring density D.

Here, it is preferred that expression (I) is satisfied in all the exposure light sources used in image recording. For example, when light sources of three colors of red, green and blue are used as the exposure light sources, it is preferred that exposure with each single color of these three colors is performed, and coloring density D at that time and blotting k in the density satisfy expression (I).

Further, it is preferred that expression (I) is satisfied in all the area of Dmin+0.2 to Dmax, but when evaluated at two points of coloring density Dmin+1 and Dmin+2, it is preferred that expression (I) is satisfied with both densities. Dmin represents the minimum value of the coloring density in the photographic material, which is equivalent to the density after processing of an unexposed film. Dmax represents the maximum value of the coloring density in the photographic material. The maximum value of coloring density is equivalent to the maximum value of the density of digital image data. In the case of widely used Cineon type, the maximum density is a value between Dmin+2 and Dmin+2.2.

As shown in FIG. 1, when stepwise exposure is performed by adjusting the exposure amount so that the photographic material develops color in density D, the width of fog in the areal direction of the photographic material of the color image in density of Dmin+0.2 is measured, and this is taken as k. Incidentally, the abscissa in FIG. 1 represents a distance.

For recording with little deterioration in the invention, it is preferred that blotting k at the time of image recording satisfies the above expression (I), more preferably satisfies the following expression (I-2) or (I-3), still more preferably satisfies the following expression (I-4) or (I-5), and most preferably satisfies the following expression (I-6).

$$k \leqq 6.5\ \mu m \times (D-0.2)^2 \quad \text{(I-2)}$$

$$k \leqq 5.5\ \mu m \times (D-0.2)^2 \quad \text{(I-3)}$$

$$k \leqq 4.5\ \mu m \times (D-0.2)^2 \quad \text{(I-4)}$$

$$k \leqq 4.0\ \mu m \times (D-0.2)^2 \quad \text{(I-5)}$$

$$k \leqq 3.5\ \mu m \times (D-0.2)^2 \quad \text{(I-6)}$$

Evaluating Method of Color Purity Rate:

When sensitometry exposure is performed with single color of each of red, green and blue, the image density obtained to the main coloring density in the single color exposure is taken as a, and other coloring different from the main coloring density present mixed in the color of the density and the coloring density of the color showing high density is taken as b, the color purity rate in the invention is represented by the following expression (B).

$$\text{Color purity rate } (\%) = (a-b)/a \times 100 \quad \text{(B)}$$

It is preferred that requisites to color purity rate of 80% or more represented by expression (B) are satisfied in all the region of from Dmin+0.1 to Dmax of the main coloring density, and it is preferred that the requisites are satisfied in every case where single color exposure of red, green and blue is performed. Dmin represents the minimum value of the coloring density in a photographic material, which is equivalent to the density after processing of an unexposed film. Dmax represents the maximum value of the coloring density in the photographic material. The maximum value of the coloring density is equivalent to the maximum value of the density of digital image data. In the case of widely used Cineon type, the maximum density is a value between Dmin+2 and Dmin+2.2.

For recording with little deterioration in the invention, color purity rate is preferably 80% or more, more preferably 85% or more, and still more preferably 90% or more.

Apparatus usable in the method of the invention in recording a digital image data on a silver halide photographic material, i.e., so-called film recorders, are not especially restricted and commercially available apparatus may be used.

For example, as commercially available apparatus, ARRILASER and ARRILASER HD using BGR laser as the light source (manufactured by ARRI), FURY and FIRESTORM using a CRT system (manufactured by CELCO), IMAGICA realtime and HSR high speed recorder using an LCOS system (manufactured by IMAGICA), and Cinevator One and Cinevator Five (manufactured by CINEVATION) are exemplified.

For achieving the above objects of the invention, it has been found from our eager investigations that it is extremely effective to use a silver halide photographic material that is designed to generate little image deterioration in recording. The primary cause of generation of blotting is the scattering of recording light in a photographic material, so that blotting of an image can be conspicuously improved by reducing the scattered light. Since light scattering is greatly influenced by the silver halide grains in a photographic material, it is effective to reduce the use amount of silver halide grains as far as possible, and it is also effective to make the size of silver halide grains small. Since any of these means causes sensitivity reduction of a photographic material, it is preferred to increase the sensitivity of a photographic material in advance. It is known that dyes can be used for absorbing scattered light, which means can be preferably used. There are water-soluble dyes and fixed dyes (oil-soluble dyes and solid dispersible dyes) in the dyes, and water-soluble dyes are widely used in conventional photographic materials, but it has been found from the results of our investigations that surprising effects can also be obtained by preferably using fixed dyes (oil-soluble dyes or solid dispersible dyes). For example, when a fixed cyan dye that absorbs red light (e.g., an oil-soluble cyan dye or solid-dispersible cyan dye) is used, it is effective to use such a dye in an upper layer nearer to a red-sensitive layer, if possible. This is presumably due to the fact that the influence of scattered light can be minimized by the elimination of red light having been subjected to scattering in the photographic material just before arriving the red-sensitive layer. Further, for increasing color purity, it is effective to prevent color mixture. When the use amount of a color mixing preventive used in the intermediate layers of each color sensitive layer is insufficient, color mixture by processing occurs, while when an excess amount is used, the sensitivity of the photographic material is reduced, so that it is effective to optimize the amount. It is also important to reduce spectral color mixture by photosensitization of a color sensitive layer different from exposure color. For example, by making the difference of green sensitivity and blue sensitivity to red sensitivity in a red-sensitive layer large, spectral color mixture can be reduced, and it is very effective for that purpose for the wavelengths of red color and red sensitivity of a photographic material to coincide at the time of recording.

Fixed dyes for use in the invention are described in more detail.

It is sufficient for a magenta dye in the invention to have spectral absorption maximum wavelength substantially in 500 to 600 nm in a dry film of the photographic material to which the dye is added, and one dye alone may be used or two or more may be used in combination.

It is sufficient for a cyan dye in the invention to have spectral absorption maximum wavelength substantially in 600 to 700 nm in a dry film of the photographic material to which the dye is added, and one dye alone may be used or two or more may be used in combination.

In the invention, the terminology "dye is fixed" means that a dye added to an objective layer in preparation of the layer during the manufacture of the photographic material is substantially present in the objective layer without being diffused to the layers other than the objective layer even after manufacture. A means to fix a dye in an objective layer may be any means, for example, the following methods are known.

As the addition methods of a dye to an objective layer, a method of directly dyeing gelatin, an oil-in-water dispersion method as described later, that is, a method of addition of a dye by dissolving the dye with a high boiling point organic solvent having a boiling point of 175° C. or higher under normal pressure and, if necessary, using an organic solvent having a boiling point of from 50 to 160° C., and emulsification dispersing the dye in a gelatin aqueous solution containing a surfactant, a method of adding a dye of solid dispersion as disclosed in WO 88/4974, JP-T-1-502912 (the term "JP-T" as used herein refers to a "published Japanese translation of a PCT application"), and EP 456148, and a method of preventing diffusion of a dye via a polymer mordant. Representative mordants are disclosed in JP-A-5-188548, [chemical 9]. Any of the above methods can be used in the invention.

In the invention, dyes are added so as to reach the average optical density of preferably from 0.005 to 0.50, and more preferably from 0.02 to 0.30, in the region of from 500 to 600 nm with a magenta dye, and in the region of from 600 to 700 nm with a cyan dye, in the dry film of an objective layer. The density is found as follows. A dye is coated with gelatin on a transparent support and dried to prepare a sample, and the density of the sample in wavelengths of from 500 to 600 nm, or from 600 to 700 nm, is measured with a spectrophotometer. An average optical density in the region of 500 to 600 nm, or from 600 to 700 nm, is found from the integrated value.

The specific examples of magenta dyes and cyan dyes for use in the invention are shown below, but the invention is not restricted to these compounds.

D-1

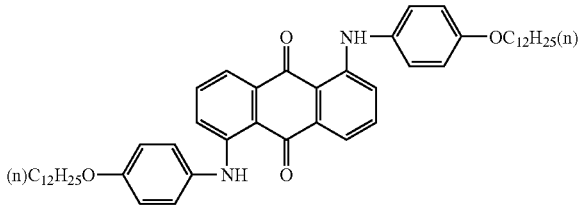

D-2

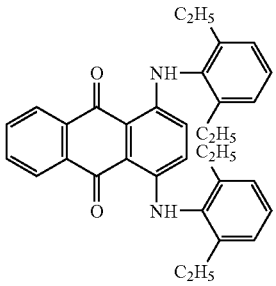

D-3

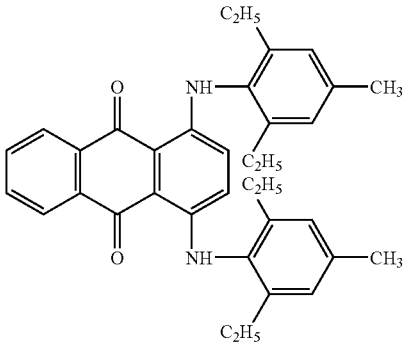

D-4

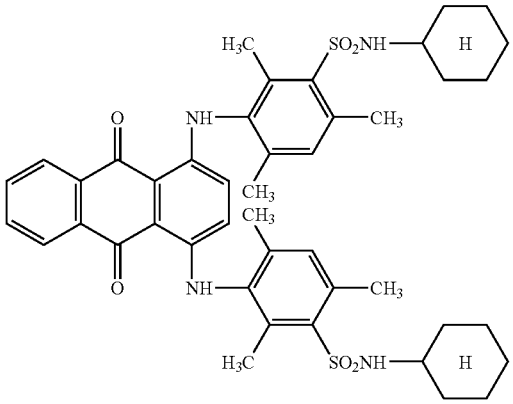

-continued
D-5
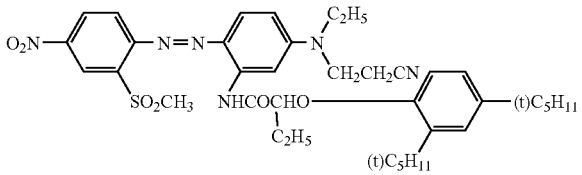
D-6
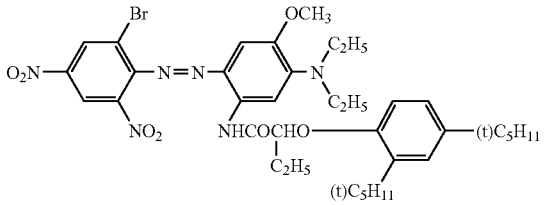
D-7
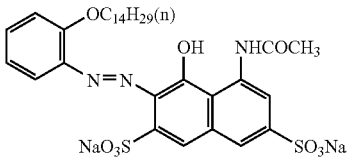
D-8
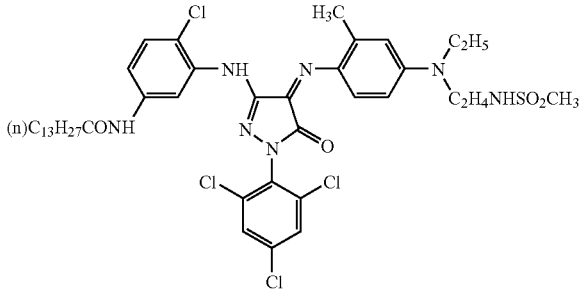
D-9
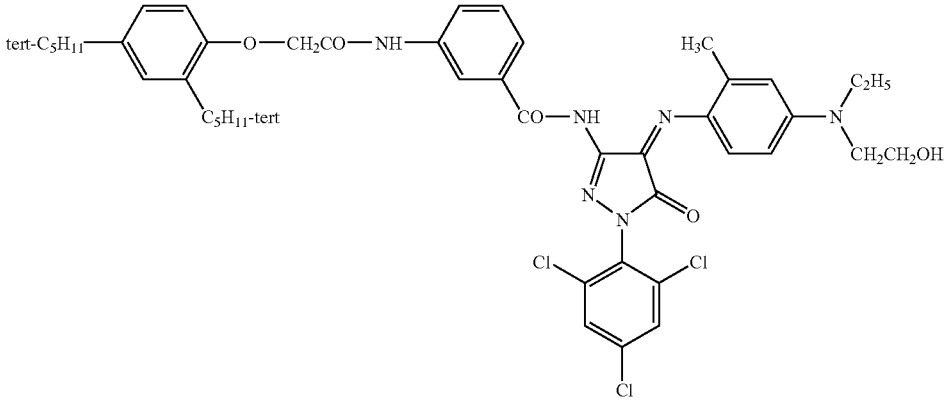
D-10
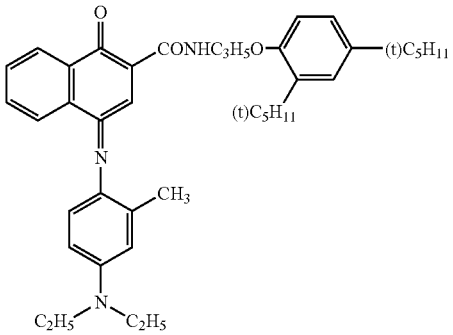
D-11
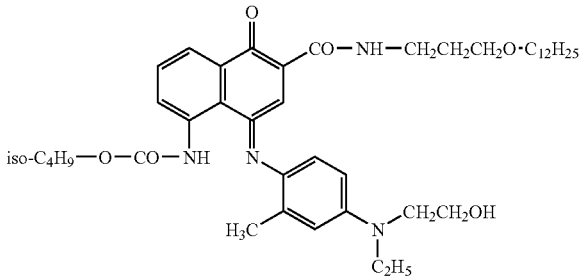

-continued
D-12
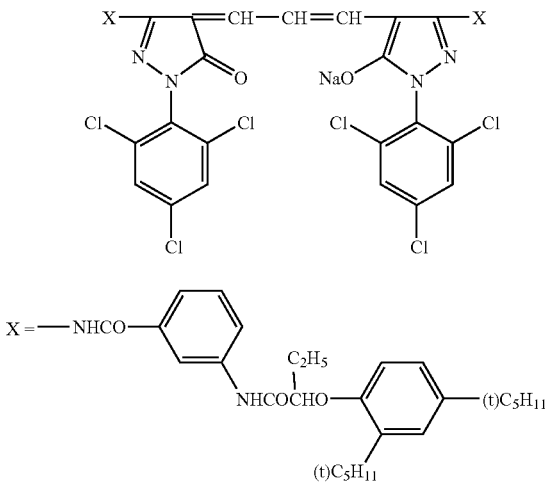
D-13
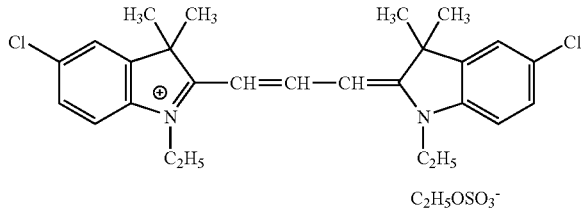
D-14
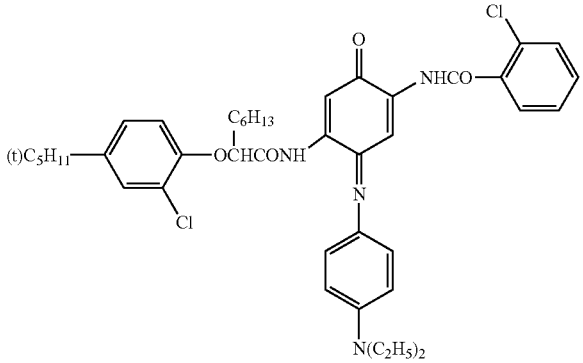
D-15
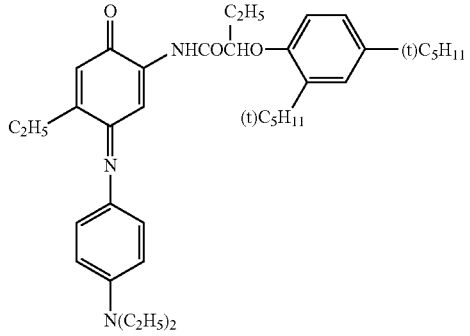
D-16
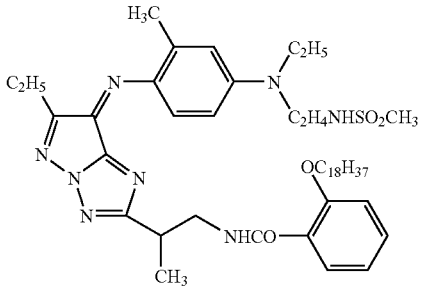
D-17
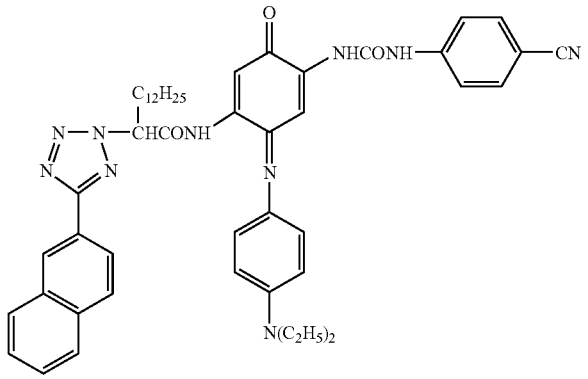
D-18
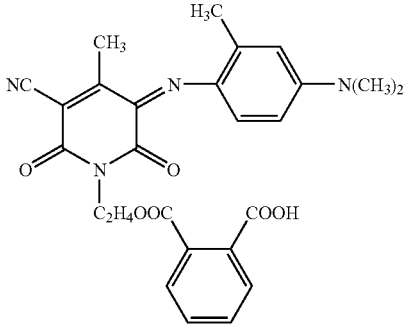
D-19
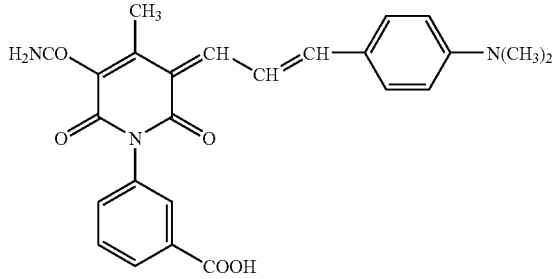

-continued
D-20
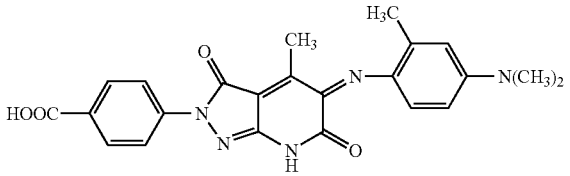
D-21
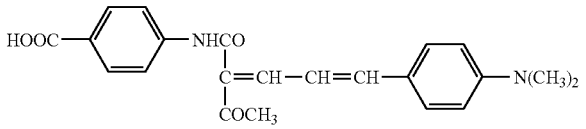
D-22
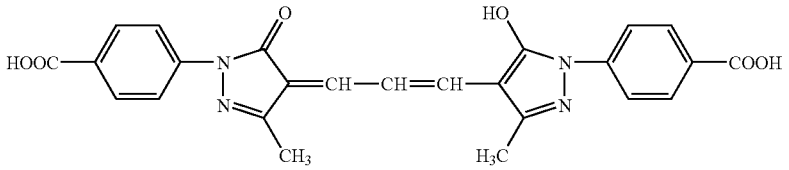
D-23
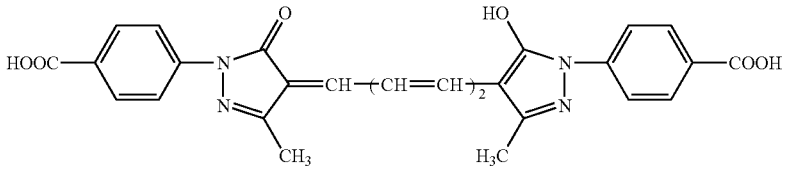
D-24
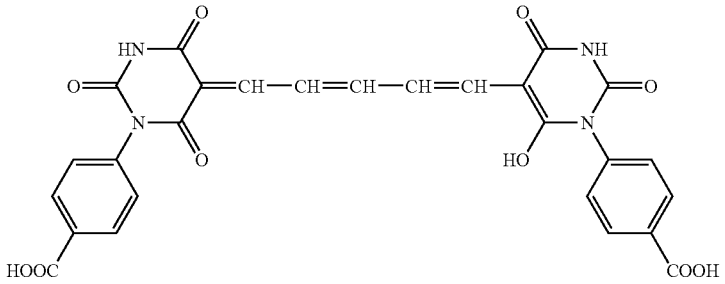
D-25
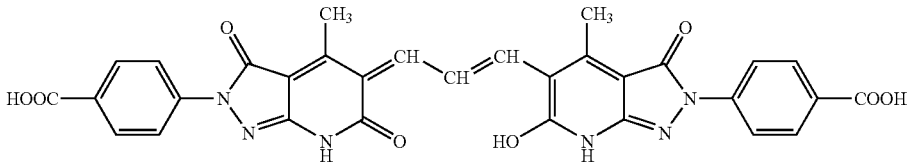
D-26
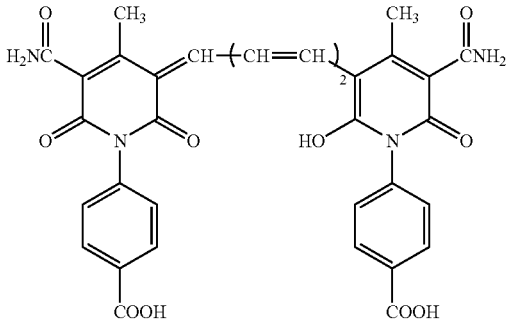
D-27
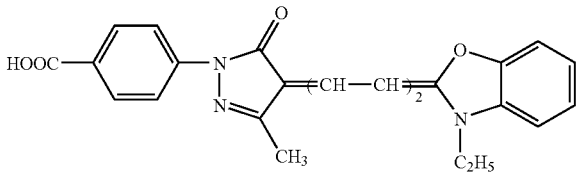

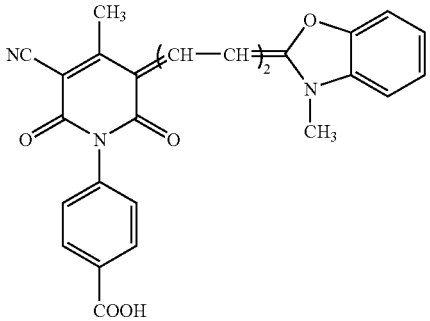

-continued

D-28

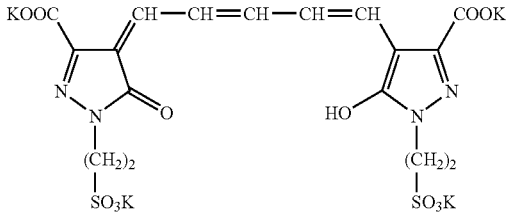

D-29

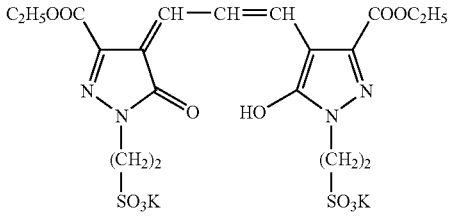

D-30

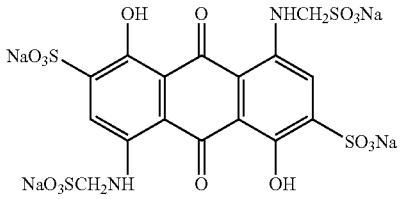

D-31

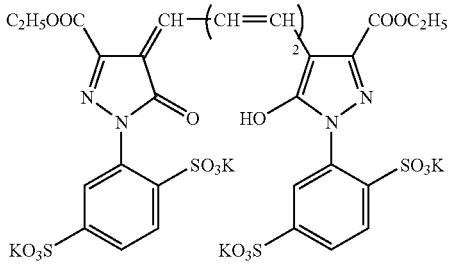

D-32

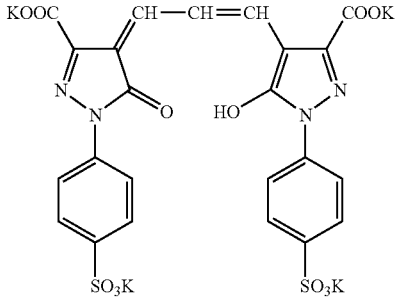

D-33

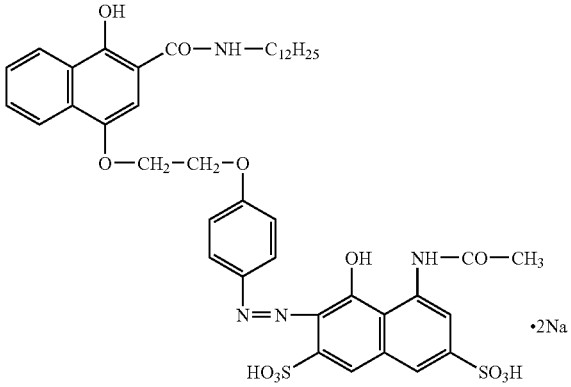

D-34

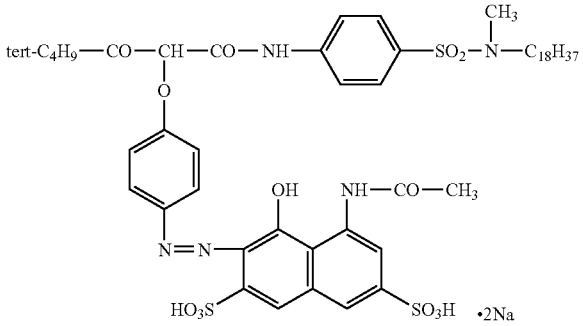

D-35

The above-exemplified compounds are disclosed in JP-A-61-48854, JP-A-61-7838, JP-A-60-243654, JP-A-60-32851, JP-A-62-276539, JP-A-52-92716, WO 88/04794, JP-A-3-7931, JP-A-4-45436, and JP-A-5-43809, or they can be synthesized according to the methods disclosed therein.

The silver halide emulsions for use in the invention are described in detail below.

The silver halide grains in photographic emulsion may be grains having regular crystal forms (three-dimensionally anisotropic), such as cubic, octahedral, and tetradecahedral grains, grains having irregular crystal forms, such as spherical and tabular grains, grains having crystal defects such as twin planes, or composites of these grains, but cubic grains and octahedral grains are preferably used in the invention, and cubic grains are more preferably used.

The grain size of the silver halide grains for use in the invention can be evaluated with an electron microscope. Specifically, in the case of a grain having a regular crystal form, a projected area-corresponding diameter (taking the projected area of the grain being equivalent to the area of the circle, the diameter of the circle) is found by observation with an electron microscope, the volume of the grain is computed from the projected area-corresponding diameter by making use of the grain being regular crystal, and the grain size can be found by computing the diameter of the sphere taking the volume of the grain being equivalent to the volume of the sphere. In the case of an irregular grain (not three-dimensionally anisotropic) such as a tabular grain, the volume is computed from the projected area-corresponding diameter and the grain thickness obtained by observation with an electron microscope, from which the equivalent-sphere diameter can be found. The equivalent-sphere diameter can also be found by the turbidity measuring method described in Particle Characterization, $2^{nd}$ Edition, items 14 to 19 (1985).

Any grain size of silver halide grains from fine grains to large size grains can be used in the invention, but the average equivalent-sphere diameter preferably used in the invention is 0.35 μm or smaller, more preferably 0.3 μm or smaller, and especially preferably 0.2 μm or smaller.

The silver halide preferably used in a light-sensitive layer in the invention is silver iodobromide, silver iodochloride or silver iodochlorobromide containing 30 mol % or less of silver iodide, and especially preferably silver iodobromide or silver iodochlorobromide containing from about 2 mol % to about 10 mol % of silver iodide.

The silver halide photographic emulsions usable in the invention can be prepared according to the methods described, e.g., in Research Disclosure (hereinafter abbreviated to RD) No. 17643 (December, 1978), pp. 22-23, I. Emulsion preparation and types, ibid., No. 18716 (November, 1979), p. 648, ibid., No. 307105 (January, 1989), pp. 863-865, P. Glafkides, Chimie et Physique Photographiques, Paul Montel (1967), G. F. Duffin, Photographic Emulsion Chemistry, Focal Press (1966), and V. L. Zelikman, et al., Making and Coating Photographic Emulsion, Focal Press (1964).

The monodispersed emulsions disclosed in U.S. Pat. Nos. 3,574,628, 3,655,394, and British Patent 1,413,748 can also be preferably used.

Crystal structure may be homogeneous, or the inside and outside of crystal structure may consist of heterogeneous halide compositions, or may take a laminar structure. Silver halides having different compositions may conjugate by epitaxial conjugation, or silver halide may conjugate with compounds other than silver halide, e.g., silver rhodanate or lead oxide. Alternatively, mixtures of grains of various crystal forms may be used.

The emulsions may have dislocation. For introducing dislocation, a method of forming a high silver iodide layer by the addition of an aqueous solution such as alkali iodide, a method of adding AgI fine grains, and the method disclosed in JP-A-5-323487 can be used.

The emulsions may be a surface latent image type emulsion forming a latent image mainly on the surface of grains, may be an internal latent image type emulsion forming a latent image on the inside of grains, or may be the type having latent images both on the surface and inside of grains, but negative emulsions are preferred. Of internal latent image type emulsions, the core/shell type internal latent image type emulsion as disclosed in JP-A-63-264740 may be used, and the preparing method thereof is disclosed in JP-A-59-133542. The thickness of the shell of this type of emulsion differs dependent upon development processing and the like, but the thickness is preferably from 3 to 40 nm, and especially preferably from 5 to 20 mm.

The emulsions for use in the invention are generally described below.

As reduction sensitization preferably used in the invention, any of the following methods can be used, for example, a method of adding a reduction sensitizer to silver halide, a method of growing or ripening silver halide grains in low pAg atmosphere of pAg of 1 to 7 called silver ripening, and a method of growing or ripening silver halide grains in high pH atmosphere of pH of 8 to 11 called high pH ripening. Two or more of these methods can be used in combination.

The method of adding a reduction sensitizer is especially preferred for capable of delicately regulating the stage of reduction sensitization.

As reduction sensitizers, stannous salt, ascorbic acid and derivatives thereof, hydroquinone and derivatives thereof, catechol and derivatives thereof, hydroxylamine and derivatives thereof, amine and polyamines, hydrazine and derivatives thereof, paraphenylenediamine and derivatives thereof, formamidinesulfinic acid (thiourea dioxide), silane compounds, and borane compounds can be exemplified. These reduction sensitizers can be selectively used in the reduction sensitization in the invention, and two or more compounds can be used in combination. In connection with the methods of reduction sensitization, the methods disclosed in U.S. Pat. Nos. 2,518,698, 3,201,254, 3,411,917, 3,779,777 and 3,930,867, and in regarding the using method of reduction sensitizers, JP-B-57-33572 (the term "JP-B" as used herein refers to an "examined Japanese patent publication"), JP-B-58-1410 and JP-A-57-179835 can be used respectively. As the reduction sensitizers, catechol and derivatives thereof, hydroxylamine and derivatives thereof, and formamidinesulfinic acid (thiourea dioxide) are preferred compounds. The compounds represented by the following formulae (II) and (III) are also preferably used as reduction sensitizers.

Formula (II)

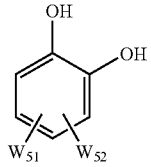

Formula (III)

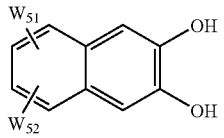

In formulae (II) and (III), $W_{51}$ and $W_{52}$ each represents a sulfo group or a hydrogen atom, provided that at least one of $W_{51}$ and $W_{52}$ represents a sulfo group. A sulfo group is generally an alkali metal salt such as of sodium or potassium, or a water-soluble salt such as ammonium salt. As preferred compounds, 3,5-disulfocatechol disodium salt, 4-sulfo-catechol ammonium salt, 2,3-dihydroxy-7-sulfonaphthalene sodium salt and 2,3-dihydroxy-6,7-disulfonaphthalene potassium salt are exemplified.

Since the addition amount of a reduction sensitizer depends upon the manufacturing conditions of emulsion, it is necessary to select addition amount, but is appropriately from $10^{-7}$ to $10^{-1}$ mol per mol of silver halide. A reduction sensitizer is dissolved in water or solvents such as alcohols, glycols, ketones, esters, or amides and added to silver halide grains during the grain growth.

As silver halide solvents that can be used in the invention, (a) organic thioethers as disclosed in U.S. Pat. Nos. 3,271,157, 3,531,289, 3,574,628, JP-A-54-1019 and JP-A-54-158917, (b) thiourea derivatives as disclosed in JP-A-53-82408, JP-A-55-77737 and JP-A-55-2982, (c) silver halide solvents having a thiocarbonyl group between an oxygen or sulfur atom and a nitrogen atom as disclosed in JP-A-53-

144319, (d) imidazoles as disclosed in JP-A-54-100717, (e) ammonia, and (f) thiocyanate are exemplified.

Especially preferred solvents are thiocyanate, ammonia and tetramethylthiourea. The amount of solvents used depends upon the kinds of solvents. For example, in the case of thiocyanate, a preferred amount is from $1\times10^{-4}$ to $1\times10^{-2}$ mol per mol of the silver halide.

In the manufacture of the emulsion in the invention, e.g., at the time of forming grains, in desalting process, at chemical sensitization, or before coating, it is preferred to make the salt of a metal ion exist according to purpose. The salt of a metal ion is preferably added at the time of grain formation in the case where grains are doped, and added after grain formation and before termination of chemical sensitization in the case where grain surface is modified or the salt of a metal ion is used as a chemical sensitizer. As described above, the whole grain may be doped, or the core part of a grain may be doped, or the shell part of a grain may be doped, or an epitaxial part alone may be doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added so long as they take the form of salta capable of being dissolved at the time of grain formation, e.g., ammonium salt, acetate, nitrate, sulfate, phosphate, hydroxy acid salt, or 4- or 6-co-ordinate complex salt. For example, $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_2IrCl_6$, $(NH_4)_3RhCl_6$, and $K_4Ru(CN)_6$ are exemplified. The ligand of coordination compound can be selected from among halo, aquo, cyano, cyanate, thiocyanate, nitrosyl, thionitrosyl, oxo and carbonyl. Metal compounds can be used alone, or two or three or more in combination.

It is preferred for metal compounds to be added by being dissolved in water or a proper organic solvent such as, methanol or acetone. For the stabilization of the solution, an aqueous solution of hydrogen halide (e.g., HCl, HBr) or alkali halide (e.g., KCl, NaCl, KBr, NaBr) may be added. Further, acid or alkali may be added, if necessary. Metal compounds can be put into a reaction vessel before grain formation, or may be added during grain formation. Metal compounds can also be added to water-soluble silver salt (e.g., $AgNO_3$) or an aqueous solution of alkali halide (e.g., NaCl, KBr, KI) and continuously added during silver halide grain formation. Further, a solution independent from an aqueous solution of hydrogen halide or alkali halide may be prepared and continuously added at proper time during grain formation. It is also preferred to combine various addition methods.

There are cases where a method of adding a chalcogen compound during grain formation as disclosed in U.S. Pat. No. 3,772,031 is useful. Cyanogen salt, thiocyanogen salt, selenocyanate, carbonate, phosphate, acetate may be present in addition to S, Se and Te.

The silver halide grains in the invention can be subjected to at least any one of sulfur sensitization, selenium sensitization, tellurium sensitization, gold sensitization, palladium sensitization, gold metal sensitization, and reduction sensitization in an arbitrary process of the manufacturing process of a silver halide emulsion. It is preferred to use two or more kinds of sensitizations in combination. Depending upon the process wherein silver halide grains are chemically sensitized, various types of emulsions can be prepared. There are emulsions of a type having a chemically sensitized speck buried inside a grain, of a type having a chemically sensitized speck buried at the shallow place from the surface of a grain, and of a type having a chemically sensitized speck formed on the surface of a grain. The emulsion of the invention can select the place of chemical sensitization, according to purposes. An emulsion having formed at least one chemically sensitized speck near the surface of a grain is generally preferred.

One chemical sensitization preferably carried out in the invention is alone or combination of chalcogen sensitization and noble metal sensitization, which chemical sensitization can be performed with activated gelatin as described in T. H. James, The Theory of the Photographic Process, $4^{th}$ Ed., pp. 67-76, Macmillan (1977), and sulfur, selenium, tellurium, gold, platinum, palladium or iridium, or a combination of a plurality of these sensitizers can be used at pAg of from 5 to 10, pH of from 5 to 8 and temperature of from 30 to 80° C. as described in Research Disclosure, Vol. 120, 12008 (April, 1974), Research Disclosure, Vol. 34, 13452 (June, 1975), U.S. Pat. Nos. 2,642,361, 3,297,446, 3,772,031, 3,857,711, 3,901,714, 4,266,018, and 3,904,415, and British Patent 1,315,755. In noble metal sensitization, noble metal salts of gold, platinum, palladium and iridium can be used, and gold sensitization, palladium sensitization and combination of both sensitizations are preferred.

In gold sensitization, gold salts described in P. Glafkides, Chimie et Physique Photographique, $5^{th}$ Ed., Paul Montel (1987) and Research Disclosure, Vol. 307, No. 307105 can be used.

As specific examples, chloroauric acid, potassium chloroaurate, potassium aurithiocyanate, and the compounds disclosed in the following patents can be used: U.S. Pat. No. 2,642,361 (gold sulfide and gold selenide), U.S. Pat. No. 3,503,749 (gold thiolate having a water-soluble group), U.S. Pat. No. 5,049,484 (bis(methylhydantoinate) gold complex), U.S. Pat. No. 5,049,485 (meso-ionic thiolate gold complex, e.g., 1,4,5-trimethyl-1,2,4-triazolium-3-thiolate gold complex), U.S. Pat. Nos. 5,252,455 and 5,391,727 (macrocyclic hetero-cyclic gold complexes), and gold compounds disclosed in U.S. Pat. Nos. 5,620,841, 5,700,631, 5,759,760, 5,759,761, 5,912,111, 5,912,112, 5,939,245, JP-A-1-147537, JP-A-8-69074, JP-A-8-69075, JP-A-9-269554, JP-B-45-29274, German Patents DD-264,524A, 264,525A, 265,474A, 298,321A, Japanese Patent Application Nos. 11-207959, 11-209825, 11-257428, 11-302918 and 2000-94527 can also be used.

The palladium compound means divalent or tetravalent salts of palladium. A preferred palladium compound is represented by formula $R_2PdX_6$ or $R_2PdX_4$, where R represents a hydrogen atom, an alkali metal atom or an ammonium group; and X represents a halogen atom, e.g., a chlorine, bromine or iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. Gold compounds and palladium compounds can be used in combination of thiocyanate or selenocyanate.

In sulfur sensitization, labile sulfur compounds as described in P. Glafkides, Chimie et Physique Photographique, $5^{th}$ Ed., Paul Montel (1987) and Research Disclosure, Vol. 307, No. 307105 can be used.

Specifically, known sulfur compounds, such as thiosulfate (e.g., hypo), thioureas (e.g., diphenylthiourea, triethylthiourea, N-ethyl-N'-(4-methyl-2-thiazolyl)thiourea, dicarboxymethyl-diethylthiourea, carboxymethyltrimethyl-thiourea), thioamides (e.g., thioacetamide), rhodanines (e.g., diethylrhodanine, 5-benzylidene-N-ethylrhodanine), phosphine sulfides (e.g., trimethylphosphine sulfide), thiohydantoins, 4-oxo-oxazolidine-2-thiones, disulfides, polysulfides (e.g., dimorpholine disulfide, cystine, hexathiocan-thione), mercapto compounds (e.g., cysteine), polythionate, and elemental sulfur, and activated gelatin can be used in sulfur sensitization. Of these compounds, thiosulfate, thioureas, phosphine sulfides, and rhodanines are especially preferred.

In selenium sensitization, labile selenium compounds are used, e.g., the compounds disclosed in JP-B-43-13489, JP-B-44-15748, JP-A-4-25832, JP-A-4-109340, JP-A-4-271341, JP-A-5-40324, JP-A-5-11385, Japanese Patent Application Nos. 4-202415, 4-330495, 4-333030, 5-4203, 5-4204, 5-106977, 5-236538, 5-241642, and 5-286916 can be used.

Specifically, colloidal metal selenium, selenoureas (e.g., N,N-dimethylselenourea, trifluoromethylcarbonyl-trimethylselenourea, acetyl-trimethylselenourea), seleno-amides (e.g., selenoamide, N,N-diethylphenylselenoamide), phosphine selenides (e.g., triphenylphosphine selenide, pentafluorophenyl-triphenylphosphine selenide), seleno-phosphates (e.g., tri-p-tollylselenophosphate, tri-n-butyl-selenophosphate), selenoketones (e.g., selenobenzophenone), isoselenocyanates, selenocarboxylic acids, seleno esters (e.g., methoxyphenylselenocarboxy-2,2-dimethoxycyclohexane ester), and diacyl selenides will suffice for selenium sensitization. Further, non-labile selenium compounds disclosed in JP-B-46-4553 and JP-B-52-34492, e.g., selenious acid, selenocyanic acid (e.g., potassium selenocyanate), selenazoles, and selenides can also be used. Phosphine selenides, selenoureas, seleno esters and selenocyanic acid are especially preferred.

In tellurium sensitization, labile tellurium compounds are used, and the labile tellurium compounds disclosed in JP-A-4-224595, JP-A-4-271341, JP-A-4-333043, JP-A-5-303157, Japanese Patent Application Nos. 4-185004, 4-330495, 4-333030, 5-4203,5-4204, 5-106977, and 5-286916 can be used.

Specifically, it will be sufficient for tellurium sensitization to use phosphine tellurides (e.g., butyl-diisopropylphosphine telluride, tributylphosphine telluride, tributoxyphosphine telluride, ethoxydiphenylphosphine telluride), diacyl (di)tellurides (e.g., bis(diphenyl-carbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea, N,N'-diphenylethylenetelluro-urea), telluroamides, and telluro esters.

As useful chemical sensitizer assistants, compounds known to restrain fog during chemical sensitization and increase sensitivity such as azaindene, azapyridazine and azapyrimidine are used. The examples of chemical sensitizer assistant modifiers are described in U.S. Pat. Nos. 2,131,038, 3,411,914, 3,554,757, JP-A-58-126526, and G. F. Duffin, Photographic Emulsion Chemistry, pp. 138 to 143.

The amount of gold sensitizers and chalcogen sensitizers for use in the invention varies according to the silver halide grains used and the conditions of chemical sensitization, but is preferably from $10^{-8}$ to $10^{-2}$ mol per mol of the silver halide, and more preferably from $10^{-7}$ to $10^{-3}$ mol or so.

The conditions of chemical sensitization in the invention are not especially restricted, but pAg is preferably from 6 to 11, more preferably from 7 to 10, pH is preferably from 4 to 10, more preferably from 5 to 8, and temperature is preferably from 40 to 95° C., and more preferably from 45 to 85° C.

It is preferred to use an oxidizing agent to silver during the manufacture of emulsion. The oxidizing agent to silver means a compound having function of capable of acting on a metallic silver to convert it to a silver ion. Compounds capable of converting very minute silver grains by-produced in the forming process of silver halide grains and a chemical sensitization process into silver ions are particularly effective. The silver ions formed may be hardly water-soluble silver salts, such as silver halide, silver sulfide, and silver selenide, or easily water-soluble silver salts, such as silver nitrate. The oxidizing agent to silver may be inorganic or organic. The examples of inorganic oxidizing agents include, e.g., ozone, hydrogen peroxide and adducts thereof (e.g., $NaBO_2.H_2O_2.3H_2O$, $2NaCO_3.3H_2O_2$, $Na4P_2O_7.2H_2O_2.2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2]6H_2O$), permanganates (e.g., $KMnO_4$), oxyacid salts such as chromates (e.g., $K_2Cr_2O_7$), halogen elements, e.g., iodine and bromine, halogen peracid salt (e.g., potassium periodate), the salts of high valency metals (e.g., potassium hexacyanoferrate(III)), and thiosulfonate.

The examples of organic oxidizing agents include quinones, e.g., p-quinone, organic peroxides, e.g., peracetic acid and perbenzoic acid, and compounds releasing activated halogen (e.g., N-bromosuccinimide, chloramine T, and chloramine B).

The oxidizing agents preferably used in the invention are inorganic oxidizing agents such as ozone, hydrogen peroxide and adducts thereof, halogen elements, and thiosulfonate, and organic oxidizing agents such as quinones. It is preferred to use in combination of the reduction sensitization with the oxidizing agents to silver. Reduction sensitization may be performed after using oxidizing agents, or vice versa, or both may coincide with each other. These methods can be used selectively in a grain forming process or a chemical sensitization process.

The photographic emulsion for use in the invention can contain various compounds for the purpose of preventing fogging and stabilizing photographic performances in the process of manufacturing, during preservation or photographic processing of a photographic material. That is, many compounds known as antifoggants and stabilizers can be added to the photographic emulsion, such as thiazoles, e.g., benzothiazolium salt, nitroimidazoles, nitrobenzimidazoles, chlorobenzimidazoles, bromobenzimidazoles, mercaptothiazoles, mercaptobenzo-thiazoles, mercaptobenzimidazoles, mercaptothiadiazoles, aminotriazoles, benzotriazoles, nitrobenzotriazoles, mercaptotetrazoles (in particular, 1-phenyl-5-mercapto-tetrazole); mercaptopyrimidines; mercaptotriazines; thioketo compounds, e.g., oxazolinethione; azaindenes, e.g., triazaindenes, tetraazaindenes (in particular, 4-hydroxy-substituted-(1,3,3a,7)tetraazaindenes), and pentaazaindenes. For example, the compounds disclosed in U.S. Pat. Nos. 3,954,474, 3,982,947, and JP-B-52-28660 can be used. As one preferred compound, the compound disclosed in JP-A-63-212932 is exemplified. Antifoggants and stabilizers can be added at various times according to purposes, e.g., before grain formation, during grain formation, after grain formation, in a water washing process, at the time of dispersion after water washing, before chemical sensitization, during chemical sensitization, after chemical sensitization, and before coating. In addition to manifestations of original prevention of fogging and stabilization effect by the addition during preparation of emulsion, antifoggants and stabilizers can be used for various purposes, such as controlling the crystal habits of grains, lessening grain size, reducing the solubility of grains, restraining chemical sensitization, controlling the arrangement of dyestuffs, and the like.

It is preferred for the photographic emulsion for use in the invention to be spectrally sensitized with methine dyestuffs and the like in view of revealing the effect of the invention. The dyestuffs that are used include cyanine dyestuffs, merocyanine dyestuffs, complex cyanine dyestuffs, complex merocyanine dyestuffs, holopolar cyanine dyestuffs, hemicyanine dyestuffs, styryl dyestuffs, and hemioxonol dyestuffs. Especially useful dyestuffs are dyestuffs belonging to cyanine dyestuffs, merocyanine dyestuffs and complex merocyanine dyestuffs. Every nucleus of basic heterocyclic nuclei generally used in cyanine dyestuffs can be applied to these dyestuffs. That is, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; nuclei obtained by condensing an alicyclic hydrocarbon ring on these nuclei; and nuclei obtained by condensing an aromatic hydrocarbon ring on these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These nuclei may have a substituent on the carbon atoms.

As the nuclei having a ketomethylene structure, 5- or 6-membered heterocyclic nuclei, e.g., a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus can be applied to merocyanine dyestuffs and complex merocyanine dyestuffs.

These sensitizing dyestuffs may be used alone, or may be used in combination, and combination of sensitizing dyestuffs is often used for the purpose of supersensitization. The representative examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, JP-A-52-110618 and JP-A-52-109925.

There may be contained in an emulsion together with sensitizing dyestuffs, a dyestuff having no spectral sensitizing action by itself or a material not substantially absorbing visible rays but showing supersensitization. The time of addition of sensitizing dyestuffs to an emulsion may be at any stage of the preparation of the emulsion recognized as useful hitherto. Sensitizing dyestuffs are most generally added during the period after termination of chemical sensitization and before coating but, as disclosed in U.S. Pat. Nos. 3,628,969 and 4,225,666, they may be added at the same time with a chemical sensitizer, and spectral sensitization may be performed simultaneously with chemical sensitization. Alternatively, as disclosed in JP-A-58-113928, spectral sensitization can be carried out prior to chemical sensitization, and it is also possible to add sensitizing dyestuffs before completion of precipitation formation of silver halide grains to initiate spectral sensitization. Further, as disclosed in U.S. Pat. No. 4,225,666, sensitizing dyestuffs can be divided and added separately, for example, one part is added prior to chemical ripening and the remaining after completion of chemical ripening, and they may be added in any stage of silver halide grain formation including the method disclosed in U.S. Pat. No. 4,183,756. The addition amount of sensitizing dyestuffs is from $4\times10^{-6}$ to $8\times10^{-3}$ mol per mol of silver halide.

It is sufficient that photographic materials to which the method of the invention is applicable have at least one blue-sensitive silver halide emulsion layer, at least one green-sensitive silver halide emulsion layer, at least one red-sensitive silver halide emulsion layer, and a light-insensitive layer on a support. A representative example is a silver halide photographic material comprising a support having provided thereon light-sensitive layers of blue-sensitive, green-sensitive and red-sensitive layers of a plurality of silver halide emulsion layers having substantially the same color sensitivity and different in light sensitivity, and at least one light-insensitive layer. The light-sensitive layers are unit light-sensitive layers having color sensitivity to any of blue light, green light and red light. In a multilayer silver halide color photographic material, the unit light-sensitive layers are generally arranged in the order of a red-sensitive layer, a green-sensitive layer and a blue-sensitive layer from the support side. However, the order of arrangement can be reversed depending upon purposes, alternatively, the light-sensitive layers may be arranged in such a way that a layer having different light sensitivity is interposed between layers having the same color sensitivity. Light-insensitive layers may be provided between and on the uppermost layer and beneath the lowermost layer of the silver halide light-sensitive layers. These light-insensitive layers may contain the couplers, DIR compounds and color mixing preventives described later. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward the support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

As one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

As disclosed in JP-B-55-34932, a blue-sensitive layer/GH/RH/GL/RL can be arranged in this order from the side farthest from the support. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivities, the layers in the unit layer of the same color sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer.

Moreover, the arrangement may be varied as indicated above in the case where there are four or more layers.

A silver halide photographic material for use in the method of the invention comprises a transparent support having provided thereon at least one blue-sensitive silver halide emulsion layer, at least one green-sensitive silver halide emulsion layer, and at least one red-sensitive silver halide emulsion layer, and it is preferred that at least one layer that is a layer on the opposite side to the support with the green-sensitive silver halide emulsion layer as the center and not the green-sensitive silver halide emulsion layer contains a fixed magenta dye, and/or at least one layer that is a layer on the side of the support with the green-sensitive silver halide emulsion layer as the center and not the green-sensitive silver halide emulsion layer contains a fixed magenta dye, and it is also preferred that at least one layer that is a layer on the opposite side to the support with the red-sensitive silver halide emulsion layer as the center and not the red-sensitive silver halide emulsion layer contains a fixed cyan dye.

Further, in a silver halide photographic material comprising a transparent support having provided thereon at least one blue-sensitive silver halide emulsion layer, at least one green-sensitive silver halide emulsion layer, and at least one red-sensitive silver halide emulsion layer, it is also preferred that at least one layer that is a layer on the opposite side to the support with the red-sensitive silver halide emulsion layer as the center and not the red-sensitive silver halide emulsion layer contains a fixed cyan dye.

In the photographic material of the invention, two or more types of emulsions that are different in terms of at least one of the characteristics of grain size, grain size distribution, halide composition, shape of the grains, and light sensitivity of the light-sensitive silver halide emulsion can be used in admixture in one and the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains that can be developed uniformly (not imagewise) irrespective of whether these grains are in an unexposed area or an exposed area of the photographic material, and methods of the preparation of these silver halide grains are disclosed in U.S. Pat. No. 4,626,498 and JP-A-59-214852. The silver halide that forms the internal nuclei of core/shell type silver halide grains having a fogged grain interior may have different halide compositions. The silver halide having a fogged grain interior or surface may be any of silver chloride, silver bromide, silver iodobromide, or silver chloroiodobromide. Further, the form of the grains may be regular grains and may be a polydispersed emulsion, but a monodispersed emulsion (at least 95% of which have a grain size within ±40% of the average equivalent sphere diameter in terms of the mass or number of silver halide grains) is preferred.

It is preferred to use light-insensitive fine-grained silver halides in the invention. Light-insensitive fine grained silver halides are fine-grained silver halides that are not sensitive to light upon imagewise exposure for obtaining color images and do not substantially undergo development in development processing, and they are preferably not pre-fogged. The silver bromide content of fine-grained silver halides is from 0 to 100 mol %, and silver chloride and/or silver iodide may be contained, if necessary. Fine-grained silver halides having a silver iodide content of from 0.5 to 10 mol % are preferred.

Fine-grained silver halide can be prepared by the same methods as the preparation of generally used light-sensitive silver halides. In the preparation of fine-grained silver halide, the surfaces of the silver halide grains may be or may not be spectrally or chemically sensitized. Further, it is preferred that known stabilizers such as triazole-based, azaindene-based, benzothiazolium-based, or mercapto-based compounds, or zinc compounds are previously added to the fine-grained silver halide before addition to a coating solution. Colloidal silver can be contained in the layer containing the fine-grained silver halide grains.

The coating weight of silver in the photographic material of the invention is preferably 8.0 g/m$^2$ or less, more preferably from 5.0 g/m$^2$ or less, and most preferably 3.0 g/m$^2$ or less.

The photographic additives usable in the invention are also described in RD and locations related thereto are indicated in the following table.

| Type of Additives | RD 17643 | RD 18716 | RD 307105 |
|---|---|---|---|
| 1. Chemical sensitizers | page 23 | page 648, right column | page 866 |
| 2. Sensitivity increasing agents | — | page 648, right column | — |
| 3. Spectral sensitizers and supersensitizers | pages 23 and 24 | page 648, right column to page 649, right column | pages 866 to 868 |
| 4. Brightening agents | page 24 | page 647, right column | page 868 |
| 5. Light absorbers, filter dyes, and UV absorbers | pages 25 and 26 | page 649, right column to page 650, left column | page 873 |
| 6. Binders | page 26 | page 651, left column | pages 873 to 874 |
| 7. Plasticizers and lubricants | page 27 | page 650, right column | page 876 |
| 8. Coating aids and surfactants | pages 26 and 27 | page 650, right column | pages 875 and 876 |
| 9. Antistatic agents | page 27 | page 650, right column | pages 876 and 877 |
| 10. Matting agents | — | — | pages 878 and 879 |

Various dye-forming couplers can be used in the invention, and the following couplers are especially preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 disclosed in U.S. Pat. No. 5,066,576; the couplers represented by formula (I), paragraph 0008 disclosed in JP-A-4-274425; the couplers disclosed in claim 1 on page 40 in EP-A-498381 (in particular, D-35 on page 18); the couplers represented by formula (Y) on page 4 disclosed in EP-A-447969 (in particular, Y-1 (page 17) and Y-54 (page 41)); and the couplers represented by any of formulae (II) to (IV), column 7, lines 36 to 58 disclosed in U.S. Pat. No. 4,476,219 (in particular, II-17 and II-19 (column 17), and II-24 (column 19)) Magenta Couplers:

L-57 (page 11, right lower column), L-68 (page 12, right lower column), and L-77 (page 13, right lower column) disclosed in JP-A-3-39737; [A-4]-63 (page 134), and [A-4]-73 to [A-4]-75 (page 139) disclosed in European Patent 456257; M-4 to M-6 (page 26) and M-7 (page 27) disclosed in European Patent 486965; M-45 (page 19) disclosed in EP-A-571959; (M-1) (page 6) disclosed in JP-A-5-204106; and M-22, paragraph 0237 disclosed in JP-A-4-362631

Cyan Couplers (Other than the Use Method and Use Layer of the Invention):

CX-1, CX-3, CX-4, CX-5, CX-11, CX-12, CX-14 and CX-15 (pages 14 to 16) disclosed in JP-A-4-204843; C-7 and C-10 (page 35), C-34 and C-35 (page 37), and (I-1) and (I-17) (pages 42 and 43) disclosed in JP-A-4-43345; and the couplers represented by formula (Ia) or (Ib) disclosed in claim 1 of JP-A-6-67385

Polymer Couplers:

P-1 and P-5 (page 11) disclosed in JP-A-2-44345

The couplers disclosed in U.S. Pat. No. 4,366,237, British Patent 2,125,570, EP-B-96873 and German Patent 3,234,533 are preferred as couplers the colored dyestuffs of which have an appropriate diffusibility.

The examples of preferred couplers for correcting the unnecessary absorption of colored dyestuffs include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) disclosed in U.S. Pat. No. 4,837,136; and the colorless masking couplers represented by formula (A) disclosed in claim 1 of WO 92/11575 (in particular, the compounds disclosed on pages 36 to 45).

The examples of compounds (inclusive of couplers) that release photographically useful residual groups of compounds upon reacting with the oxidation product of a developing agent include the following:

Development Inhibitor Releasing Compounds:

The compounds represented by formula (I), (II), (III) or (IV) disclosed on page 11 of EP-A-378236 (in particular, T-101 (page 30), T-104 (page 31), T-113 (page 36), T-131 (page 45), T-144 (page 51), and T-158 (page 58); the compounds represented by formula (I) disclosed on page 7 of EP-A-436938 (in particular, D-49 (page 51)); the compounds represented by formula (1) disclosed in EP-A-568037 (in particular, (23) (page 11); and the compounds represented by formula (I), (II) or (III) disclosed on pages 5 and 6 in EP-A-440195 (in particular, I-(1) on page 29)

Bleaching Accelerator Releasing Compounds:

The compounds represented by formula (I) or (I') disclosed on page 5 in EP-A-310125 (in particular, (60) and (61) on page 1); and the compounds represented by formula (I) disclosed in claim 1 in JP-A-6-59411 (in particular, (7) on page 7)

Ligand Releasing Compounds:

The compounds represented by LIG-X disclosed in claim 1 in U.S. Pat. No. 4,555,478 (in particular, the compounds in lines 21 to 41, column 12)

Leuco Dyestuff Releasing Compounds:

Compounds 1 to 6, columns 3 to 8 disclosed in U.S. Pat. No. 4,749,641

Fluorescent Dyestuff Releasing Compounds:

The compounds represented by COUP-DYE disclosed in claim 1 in U.S. Pat. No. 4,774,181 (in particular, Compounds 1 to 11 in columns 7 to 10)

Development Accelerator Releasing or Fogging Agent Releasing Compounds:

The compounds represented by formula (1), (2) or (3), column 3 in U.S. Pat. No. 4,656,123 (in particular, Compound (I-22) in column 25); and Compound ExZK-2, lines 36 to 38, page 75 in EP-A-450637

Compounds Releasing Groups the Color of which is Restored after Desorption:

The compounds represented by formula (I) disclosed in claim 1 of U.S. Pat. No. 4,857,447 (in particular, Y-1 to Y-19 in columns 25 to 36)

Preferred additives other than the couplers are listed below:

Dispersion Media of Oil-soluble Organic Compound:

P-3, P-5, P-16, P-19, P-25, P-30, P-42, P-49, P-54, P-55, P-66, P-81, P-85, P-86, and P-93 (pages 140 to 144) disclosed in JP-A-62-215272

Latexes for Impregnation of Oil-soluble Organic Compound:

The latexes disclosed in U.S. Pat. No. 4,199,363

Scavengers of the Oxidant of a Developing Reagent:

The compounds represented by formula (I), lines 54 to 62, column 2 of U.S. Pat. No. 4,978,606 (in particular, I-(1), I-(2), I-(6), and I-(12), columns 4 and 5); and the compounds represented by the formula disclosed in lines 5 to 10, column 2 of U.S. Pat. No. 4,923,787 (in particular, Compound 1, column 3)

Stain Inhibitors:

The compounds represented by formula (I), (II) or (III), lines 30 to 33, page 4 of EP-A-298321 (in particular, I-47, I-72, III-1, and III-27, pages 24 to 48)

Discoloration Inhibitors:

A-6, A-7, A-20, A-21, A-23, A-24, A-25, A-26, A-30, A-37, A-40, A-42, A-48, A-63, A-90, A-92, A-94, and A-164 (pages 69 to 118) disclosed in EP-A-298321; II-1 to III-23, columns 25 to 38 disclosed in U.S. Pat. No. 5,122,444 (in particular, 111-10); I-1 to III-4, pages 8 to 12 of EP-A-471347 (in particular, II-2); and A-1 to A-48, columns 32 to 40 in U.S. Pat. No. 5,139,931 (in particular, A-39 and A-42)

Compounds for Reducing the Using Amounts of Color Intensifiers and Color Mixing Preventives:

I-1 to II-15, pages 5 to 24 in EP-A-411324 (in particular, I-46)

Formaldehyde Scavengers:

SCV-1 to SCV-28, pages 24 to 29 of EP-A-477932 (in particular, SCV-8)

Hardening Agents:

H-1, H-4, H-6, H-8 and H-14 on page 17 of JP-A-1-214845; the compounds represented by any of formulae (VII) to (XII), columns 13 to 23 in U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287

Development Inhibitor Precursors:

P-24, P-37 and P-39 on pages 6 and 7 of JP-A-62-168139; and the compounds disclosed in claim 1 of U.S. Pat. No. 5,019,492 (in particular, Compounds 28 and 29 in column 7)

Antiseptics and Mildewproofing Agents:

I-1 to III-43 in columns 3 to 15 of U.S. Pat. No. 4,923,790 (in particular, II-1, II-9, II-10, II-18 and III-25)

Stabilizers and Antifoggants:

I-1 to (14), columns 6 to 16 of U.S. Pat. No. 4,923,793 (in particular, I-1, 60, (2) and (13)); and Compounds 1 to 65 in columns 25 to 32 of U.S. Pat. No. 4,952,483 (in particular, Compound 36)

Chemical Sensitizers:

Triphenylphosphine selenide; and Compound 50 disclosed in JP-A-5-40324 Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124 on pages 8 to 26 of WO 88/04794; Compounds 1 to 22 on pages 6 to 11 of EP-A-319999 (in particular, Compound 1); Compounds D-1 to D-87 represented by any of formulae (1) to (3), pages 3 to 28 of EP-A-519306; Compounds 1 to 22 represented by formula (I), columns 3 to 10 of U.S. Pat. No. 4,268,622; and Compounds (1) to (31) represented by formula (I) on columns 2 to 9 of U.S. Pat. No. 4,923,788

UV Absorbers:

Compounds (18b) to (18r) represented by formula (1), 101 to 427 on pages 6 to 9 of JP-A-46-3335; Compounds (3) to (66) represented by formula (I) on pages 10 to 44, and Compounds HBT-1 to HBT-10 represented by formula (III) on page 14 of EP-A-520938; and Compounds (1) to (31) represented by formula (1) in columns 2 to 9 of EP-A-521823

Suitable supports usable in the invention are described, e.g., in RD, No. 17643, page 28, ibid., No. 18716, from right column on page 647 to left column on page 648, and ibid., No. 307105, page 879.

The total thickness from the light-sensitive silver halide layer nearest to the support to the surface of the photographic material of the invention is preferably 24 μm or less, more preferably 22 μm or less, and most preferably 20 μm or less. Further, the film swelling rate T½ is preferably 30 seconds or less, and more preferably 20 seconds or less. Taking 90% of the maximum swollen film thickness reached when a film is processed at 30° C. for 3 minutes and 15 seconds in a color developing solution as the saturated film thickness, T½ is defined as the time to reach ½ of the saturated film thickness. The film thickness means the film thickness measured under conditions of 25° C., relative humidity of 55% (stored for 2 days), and T½ can be measured using a swellometer of the type described in A. Green, Photogr. Sci. Eng., Vol. 19, No. 2, pages 124 to 129. T½ can be adjusted by adding hardening agents to gelatin that is used as a binder, or by changing the aging conditions after coating. Further, a swelling factor of from 150% to 400% is preferred. The swelling factor can be computed from the maximum swollen film thickness obtained under the conditions described above according to the expression: (maximum swollen film thickness−film thickness)/film thickness.

In the photographic material of the present invention, it is preferred to provide a hydrophilic colloid layer (called as a backing layer) having a total dry film thickness of from 2 to 20 μm on the side of the support opposite to the side on which emulsion layers are provided. The inclusion of the above described light absorber, filter dye, ultraviolet absorber, antistatic agent, hardening agent, binder, plasticizer, lubricant, coating aid, and surfactant in the backing layer is preferred. The swelling factor of the backing layer is preferably from 150 to 500%.

The polyester supports for use in the present invention are described below, but details including photographic materials described later, processing, cartridges and examples are described in Kokai-Giho, Kogi No. 94-6023 (Hatsumei-Kyokai, Mar. 15, 1994). The polyester for use in the invention is formed with diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols diethylene glycol, triethylene glycol, cyclohexanedimethanol, bisphenol A, and bisphenol are enumerated. The polymers thereof include homopolymers such as polyethylene terephthalate, polyethylene naphthalate, polycyclohexane-dimethanol terephthalate, etc. Particularly preferred polymer is polyester containing from 50 mol % to 100 mol % of 2,6-naphthalenedicarboxylic acid. Especially preferred above all is polyethylene-2,6-naphthalate. The range of the average molecular weight of these polymers is from about 5,000 to 200,000. Tg of the polyesters for use in the present invention is preferably 50° C. or more, and more preferably 90° C. or more.

The polyester support is heat treated at 40° C. or more and less than Tg, more preferably Tg minus 20° C. or more to less than Tg, for the purpose of being reluctant to get curling habit. The heat treatment may be carried out at constant temperature within this range or may be carried out with cooling. The heat treatment time is preferably from 0.1 to 1,500 hours, more preferably from 0.5 to 200 hours. The heat treatment of the support may be carried out in a roll state or may be carried out in a web state while transporting. The surface of the support may be provided with concavities and convexities (e.g., coating conductive inorganic fine grains such as $SnO_2$ or $Sb_2O_5$) to improve the surface state. Further, it is desired to contrive so as to prevent cut end photographing of the rolled core part by providing knurling at the end part and making only the end part a little high. The heat treatment may be carried out at any stage after film formation of a support, after surface treatment, after coating of a backing layer (an antistatic agent, a sliding agent, etc.), or after undercoating, but preferably performed after coating of an antistatic agent.

An ultraviolet absorber may be kneaded into the polyester support. Further, light piping can be prevented by kneading a commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as chemical treatment, mechanical treatment, corona discharge treatment, flame treatment, ultraviolet treatment, high frequency treatment, glow discharge treatment, active plasma treatment, laser treatment, mixed acid treatment, and ozone oxidation treatment. Of these surface activation treatments, ultraviolet irradiation treatment, flame treatment, corona discharge treatment, and glow discharge treatment are preferred.

An undercoating method is described below. An undercoat layer may be a single layer or may comprise two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds that swell a support include resorcin and p-chlorophenol. Gelatin-hardening agents for an undercoat layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, $TiO_2$, inorganic fine particles or polymethyl methacrylate copolymer fine particles (0.01 to 10 μm) may be contained in an undercoat layer as a matting agent.

Further, antistatic agents are preferably used in the invention. The examples of such antistatic agents include polymers containing carboxylic acid and carboxylate or sulfonate, cationic polymers, and ionic surfactant compounds.

The most preferred antistatic agents are fine particles of at least one kind of crystalline metallic oxide selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7\Omega\cdot$cm or less, more preferably $10^5\Omega\cdot$cm or less and having a particle size of from 0.001 to 1.0 μm, or fine particles of composite oxides of these metallic oxides (Sb, P, B, In, S, Si, C, etc.), further, fine particles of metallic oxides in a sol state, or fine particles of composite oxides of these metallic oxides.

The addition amount of an antistatic agent to the photographic material is preferably from 5 to 500 mg/m$^2$ and especially preferably from 10 to 350 mg/m$^2$. The ratio of the amount of the conductive crystalline oxides or composite oxides thereof to the binder is preferably from 1/300 to 100/1, and more preferably from 1/100 to 100/5.

It is preferred for the photographic material of the invention to have a sliding property. The layer containing a sliding agent is preferably provided on both sides of the light-sensitive layer side and the backing layer side. A preferred sliding property is a dynamic friction coefficient of 0.25 or less and 0.01 or more. The value is a value obtained by the measurement with a stainless steel ball having a diameter of 5 mm at a transporting speed of 60 cm/min (25° C., 60% RH). In this evaluation, when the opposite material is replaced with the light-sensitive layer surface, almost the same level of value can be obtained.

The examples of the sliding agents usable in the invention include polyorganosiloxane, higher fatty acid amide, higher fatty acid metal salt, ester of higher fatty acid and higher alcohol, etc. As polyorganosiloxane, polydimethyl-siloxane, polydiethylsiloxane, polystyrylmethylsiloxane, and polymethylphenylsiloxane can be used. The addition layer is preferably the outermost layer of emulsion layers or a backing layer. In particular, polydimethylsiloxane and esters having a long chain alkyl group are preferred.

The photographic material of the invention preferably contains a matting agent. The matting agent may be added to either of the emulsion layer side or the backing layer side but it is especially preferably to be added to the outermost layer of emulsion layers. The matting agent may be either soluble or insoluble in the processing solution, and preferably both types are used in combination. For example, polymethyl methacrylate, poly(methyl methacrylate/methacrylic acid=9/1 or 5/5 (in molar ratio)), and polystyrene particles are preferably used as matting agents. The particle size is preferably from 0.8 to 10 μm, and particle size distribution is preferably narrow, preferably particles having particle sizes of from 0.9 to 1.1 times the average equivalent-sphere diameter accounts for 90% or more of the entire particle number. For increasing a matting property, fine particles having a particle size of 0.8 μm or less are preferably added at the same time. For example, polymethyl methacrylate (0.2 μm), poly(methyl methacrylate/methacrylic acid=9/1 (in molar ratio), 0.3 μm), polystyrene particles (0.25 μm), and colloidal silica (0.03 μm) are exemplified.

As the image-forming method of recording on a silver halide photographic material according to an analog system in the invention, a contact printing method of performing exposure by bringing a silver halide photographic material recorded with a digital image data into contact with a silver halide photographic material not recorded with a digital image data or an unexposed silver halide photographic material is known. As the apparatus for the contact printing method, e.g., BELL &amp, Model C Printer manufactured by HOWELL can be used.

EXAMPLE

The invention will be described with reference to examples, but the invention is not restricted thereto.

Example 1

Preparation of Emulsion Em-A:

An AgBrI monodispersed cubic emulsion was prepared according to the following method. In the first place, the following solutions were prepared.

Solution A:

An aqueous solution containing 30 g of lime-processed ossein gelatin, 0.4 g of KBr, and 1.3 liters of water Solution B:

An aqueous solution (0.2 liters) containing 20 g of $AgNO_3$

Solution C:

An aqueous solution (0.2 liters) containing 15 g of KBr and 0.6 g of KI

Solution D:

An aqueous solution (0.65 liters) containing 162.5 g of $AgNO_3$

Solution E:

An aqueous solution (0.7 liters) containing 124.8 g of KBr, 5.4 g of KI, and 0.6 g of NaCl Solution A was put into a reaction vessel and stirred with maintaining the temperature at 60° C. Solution B (150 ml) was added to the above solution over 5 minutes. Solution C was added to the solution by controlling the addition amount so as to maintain pBr in the reaction vessel during the time at 3.5. After termination of the addition, the temperature of the solution in the reaction vessel was raised to 70° C. After that, 540 ml of solution D was added to the reaction solution over 15 minutes. Solution E was added thereto by controlling the addition amount so as to maintain pBr in the reaction vessel during the time at 3.5. During the addition, 0.005 g of thiourea dioxide, 0.005 g of sodium benzenesulfonate, and 0.0003 g of $K_2IrCl_6$ were added into the reaction vessel.

After completion of the addition, the emulsion was desalted by flocculation. After termination of desalting process, the solution was subjected to the following chemical sensitization and spectral sensitization. The emulsion after being desalted was maintained at 60° C., and sensitizing dyestuffs, potassium thiocyanate, chloroauric acid, sodium thiosulfate, N,N-dimethylselenourea, 4-hydroxy-6-methyl-1,3,3a,7-tetra-azaindene (TAI), Compound 1, Compound 2, and Compound 3 were added and the emulsion was optimally spectrally and chemically sensitized. The sensitizing dyestuffs shown in Table 1 below were added in optimal amounts by arbitrarily varying the addition ratio. The obtained grains were cubic grains having an average equivalent-sphere diameter of 0.18 μm and the coefficient of variation of equivalent-sphere diameter of 11%.

Preparation of Emulsions Em-B, Em-D and Em-G:

Emulsions Em-B, Em-D and Em-G were prepared in the same manner as in the preparation of Emulsion Em-A, except for arbitrarily changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization.

Preparation of Emulsion Em-C:

An AgBrI monodispersed cubic emulsion was prepared according to the following method. In the first place, the following solutions were prepared.

Solution A:

An aqueous solution containing 30 g of lime-processed ossein gelatin, 0.4 g of KBr, and 1.5 liters of water Solution B:

An aqueous solution (0.65 liters) containing 162.5 g of $AgNO_3$

Solution C:

An aqueous solution (0.7 liters) containing 125.4 g of KBr, 4.5 g of KI, and 0.3 g of NaCl Solution A was put into the reaction vessel and stirred with maintaining the temperature at 55° C. Solution B (540 ml) was added to the above solution over 10 minutes. Solution C was added to the solution by controlling the addition amount so as to maintain pBr in the reaction vessel during the time at 3.5. During the addition, 0.007 g of thiourea dioxide, 0.007 g of sodium benzenesulfonate, and 0.0005 g of $K_2IrCl_6$ were added into the reaction vessel.

After completion of the addition, the emulsion was desalted by flocculation. After termination of desalting process, the solution was subjected to the following chemical sensitization and spectral sensitization. The emulsion after being desalted was maintained at 62° C., and sensitizing dyestuffs, chloroauric acid, sodium thiosulfate, 4-hydroxy-6-methyl-1,3,3a,7-tetraazaindene (TAI), Compound 1, Compound 2, and Compound 3 were added and the emulsion was optimally spectrally and chemically sensitized. The addition amounts of the sensitizing dyestuffs were as shown in Table 1 below. The obtained grains were cubic grains having an average equivalent-sphere diameter of 0.09 μm and the coefficient of variation of equivalent-sphere diameter of 13%.

Preparation of Emulsions Em-E, Em-F, Em-H and Em-I:

Emulsions Em-E, Em-F, Em-H and Em-I were prepared in the same manner as in the preparation of Emulsion Em-C, except for arbitrarily changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization.

TABLE 1

| Name of Emulsion | Shape of Grain | Average Grain Size (μm) | Coefficient of Variation (%) | Content of I (mol %) | Content of Cl (mol %) | Sensitizing Dyestuffs (addition amount) |
|---|---|---|---|---|---|---|
| Em-A | Cubic | 0.18 | 12 | 3.5 | 1 | ExS-1 ($7.5 \times 10^{-5}$)/ExS-2 ($3.8 \times 10^{-4}$)/ExS-3 ($3.0 \times 10^{-4}$) |
| Em-B | Cubic | 0.15 | 12 | 3.2 | 0 | ExS-1 ($1.4 \times 10^{-4}$)/ExS-2 ($7.3 \times 10^{-4}$)/ExS-3 ($5.8 \times 10^{-4}$) |
| Em-C | Cubic | 0.09 | 13 | 2.5 | 0.5 | ExS-1 ($2.0 \times 10^{-4}$)/ExS-2 ($1.0 \times 10^{-3}$)/Exs-3 ($8.0 \times 10^{-4}$) |
| Em-D | Cubic | 0.11 | 12 | 3.3 | 0.5 | ExS-4 ($2.5 \times 10^{-4}$)/ExS-5 ($2.5 \times 10^{-4}$)/ExS-6 ($2.5 \times 10^{-4}$)/ ExS-7 ($2.5 \times 10^{-4}$) |
| Em-E | Cubic | 0.09 | 12 | 2.8 | 0 | ExS-4 ($4.0 \times 10^{-4}$)/ExS-5 ($4.0 \times 10^{-4}$)/ExS-6 ($4.0 \times 10^{-4}$)/ ExS-7 ($4.0 \times 10^{-4}$) |
| Em-F | Cubic | 0.08 | 14 | 2.2 | 0 | ExS-4 ($2.2 \times 10^{-4}$)/ExS-5 ($2.2 \times 10^{-4}$)/ExS-6 ($2.2 \times 10^{-4}$)/ ExS-7 ($2.2 \times 10^{-4}$) |
| Em-G | Cubic | 0.34 | 13 | 3.5 | 1 | ExS-8 ($8.8 \times 10^{-5}$)/ExS-9 ($2.8 \times 10^{-5}$)/ExS-10 ($1.4 \times 10^{-5}$) |
| Em-H | Cubic | 0.15 | 15 | 3.5 | 0 | ExS-8 ($4.5 \times 10^{-4}$)/ExS-9 ($1.4 \times 10^{-4}$)/ExS-10 ($6.8 \times 10^{-5}$) |
| Em-I | Cubic | 0.10 | 15 | 3.5 | 0 | ExS-8 ($1.0 \times 10^{-3}$)/ExS-9 ($3.0 \times 10^{-4}$)/ExS-10 ($1.5 \times 10^{-4}$) |

* The average grain size means the average of equivalent-sphere diameters. The coefficient of variation is the coefficient of variation of the equivalent-sphere diameters.

* In the parentheses of each of the compounds of sensitizing dyestuffs is the addition amount (unit: mol/mol Ag).

Manufacture of Multilayer Color Photographic Material Sample 101:

A backing layer shown below was coated on a cellulose triacetate film support having an undercoat layer to prepare a support.

| Backing layer: | |
|---|---|
| Methyl methacrylate/methacrylic acid copolymer (copolymerization molar ratio: 1/1) | 1.5 mass parts |
| Cellulose acetate hexahydrophthalate (a hydroxypropyl group: 4%, a methyl group: 15%, an acetyl group: 8%, a phthalyl group: 36%) | 1.5 mass parts |
| Acetone | 50 mass parts |
| Methanol | 25 mass parts |
| Methyl cellosolve | 25 mass parts |
| Colloidal carbon | 1.2 mass parts |

A coating solution was prepared by the above ratio, and coated so as to reach the density against white light of 1.0. (In this specification, mass ratio is equal to weight ratio.)

An undercoat layer was coated on the side of the support opposite to the side on which the backing layer was coated, and each layer having the composition shown below was coated on the undercoat layer to manufacture a multilayer color photographic material sample 101.

Composition of Photographic Material:

The coating amounts of the silver halide and colloidal silver were shown as the coating amount of silver in the unit of g/m$^2$, and the amounts of the coupler, additive and gelatin were shown in the unit of g/m$^2$.

| First layer: antihalation layer | |
|---|---|
| Black colloidal silver | 0.090 as silver |
| Silver iodobromide emulsion grains (average equivalent-sphere diameter: 0.07 μm, silver iodide content: 2 mol %) | 0.020 as silver |
| Gelatin | 0.910 |
| **Second layer: intermediate layer** | |
| Gelatin | 2.160 |
| ExF-4 | 0.694 |
| **Third layer: low sensitivity red-sensitive emulsion layer** | |
| Em-I | 0.265 as silver |
| Gelatin | 1.900 |
| ExC-1 | 0.141 |
| ExC-2 | 0.194 |
| ExC-3 | 0.019 |
| ExC-4 | 0.034 |
| ExC-5 | 0.029 |
| Cpd-2 | 0.105 |
| Solv-1 | 0.440 |
| **Fourth layer: middle sensitivity red-sensitive emulsion layer** | |
| Em-H | 0.236 as silver |
| Gelatin | 1.067 |
| ExC-1 | 0.091 |
| ExC-2 | 0.125 |
| ExC-3 | 0.040 |
| ExC-4 | 0.028 |
| ExC-5 | 0.008 |
| Cpd-2 | 0.069 |
| Solv-1 | 0.293 |
| **Fifth layer: high sensitivity red-sensitive emulsion layer** | |
| Em-G | 0.228 as silver |
| Gelatin | 0.757 |

-continued

| | |
|---|---|
| ExC-1 | 0.057 |
| ExC-2 | 0.079 |
| ExC-3 | 0.019 |
| ExC-5 | 0.005 |
| Cpd-2 | 0.044 |
| Solv-1 | 0.165 |
| **Sixth layer: intermediate layer** | |
| Gelatin | 1.489 |
| Cpd-1 | 0.069 |
| ExF-5 | 0.074 |
| ExF-7 | 0.062 |
| ExF-8 | 0.028 |
| Solv-1 | 0.223 |
| **Seventh layer: low sensitivity green-sensitive emulsion layer** | |
| Em-F | 0.306 as silver |
| Gelatin | 1.614 |
| ExM-1 | 0.164 |
| ExM-3 | 0.095 |
| ExM-4 | 0.148 |
| Solv-1 | 0.473 |
| Solv-2 | 0.050 |
| **Eighth layer: middle sensitivity green-sensitive emulsion layer** | |
| Em-E | 0.187 as silver |
| Gelatin | 0.525 |
| ExM-1 | 0.048 |
| ExM-2 | 0.037 |
| ExM-3 | 0.021 |
| ExM-4 | 0.043 |
| Solv-1 | 0.171 |
| Solv-2 | 0.020 |
| **Ninth layer: high sensitivity green-sensitive emulsion layer** | |
| Em-D | 0.254 as silver |
| Gelatin | 0.447 |
| ExM-1 | 0.040 |
| ExM-2 | 0.031 |
| ExM-3 | 0.018 |
| ExM-4 | 0.036 |
| Solv-1 | 0.150 |
| Solv-2 | 0.010 |
| **Tenth layer: yellow filter layer** | |
| Yellow colloidal silver | 0.064 as silver |
| Gelatin | 0.950 |
| Cpd-1 | 0.105 |
| ExF-8 | 0.028 |
| Solid dispersion dye ExF-9 | 0.125 |
| Solv-1 | 0.121 |
| **Eleventh layer: low sensitivity blue-sensitive emulsion layer** | |
| Em-C | 0.137 as silver |
| Gelatin | 1.514 |
| ExY-1 | 0.056 |
| ExY-2 | 0.561 |
| ExC-2 | 0.008 |
| Solv-1 | 0.234 |
| **Twelfth layer: middle sensitivity blue-sensitive emulsion layer** | |
| Em-B | 0.149 as silver |
| Gelatin | 0.859 |
| ExY-1 | 0.039 |
| ExY-2 | 0.391 |
| ExC-3 | 0.009 |
| Solv-1 | 0.163 |
| **Thirteenth layer: high sensitivity blue-sensitive emulsion layer** | |
| Em-A | 0.283 as silver |
| Gelatin | 0.371 |
| ExY-1 | 0.010 |
| ExY-2 | 0.101 |
| ExC-3 | 0.003 |
| Solv-1 | 0.042 |

-continued

| Fourteenth layer: first protective layer | |
|---|---|
| Silver iodobromide emulsion grains (average equivalent-sphere diameter: 0.07 μm, silver iodide content: 2 mol %) | 0.211 as silver |
| Gelatin | 0.683 |
| Solid dispersion dye ExF-9 | 0.054 |
| ExF-1 | 0.073 |
| H-1 | 0.160 |
| **Fifteenth layer: second protective layer** | |
| Gelatin | 0.727 |
| B-1 (diameter: 2.0 μm) | 0.007 |
| B-2 (diameter: 2.0 μm) | 0.005 |
| B-3 | 0.047 |
| H-1 | 0.170 |

To the thus manufactured Sample 101 were added 1,2-benzisothiazolin-3-one (200 ppm on average to gelatin), n-butyl-p-hydroxybenzoate (about 1,000 ppm, the same as above), and 2-phenoxyethanol (about 10,000 ppm, the same as above), in addition to the above.

Cpd-3 to Cpd-7, B-4, B-5, W-1 to W-13, F-1 to F-21, ExF-2, ExF-3, ExF-6, UV-1 to UV-5 were further added.

Preparation of Organic Solid Dispersion Dye:

Solid dispersion dye ExF-9 in the tenth layer was dispersed by the following method.

| | |
|---|---|
| Wet cake of ExF-9 (containing 17.6 mass % of water) | 1.210 kg |
| W-11 | 0.400 kg |
| F-15 | 0.006 kg |
| Water | 8.384 kg |
| Total | 10.000 kg |

(pH was adjusted to 7.2 with NaOH)

The slurry having the above composition was coarsely dispersed by stirring with a dissolver, and then dispersed with agitator mill LMK-4 at a peripheral speed of 10 m/sec, discharge amount of 0.6 kg/min, and packing rate of 80% of zirconia beads having a diameter of 0.3 mm to obtain solid fine particle dispersion. The average equivalent-sphere diameter of the dye fine particles was 0.15 μm.

The structural formulae of the materials used in the above photographic material are shown below.

ExS-1

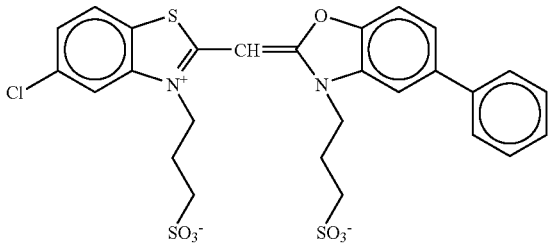

ExS-2

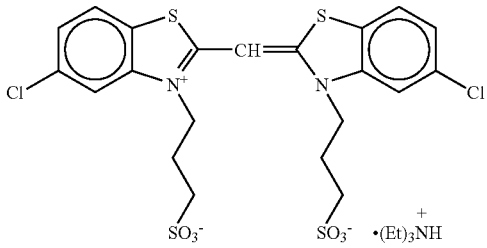

ExS-3

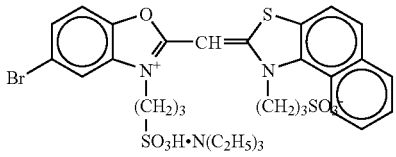

ExS-4

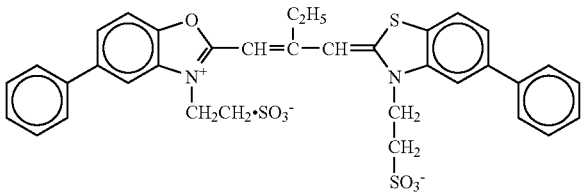

ExS-5

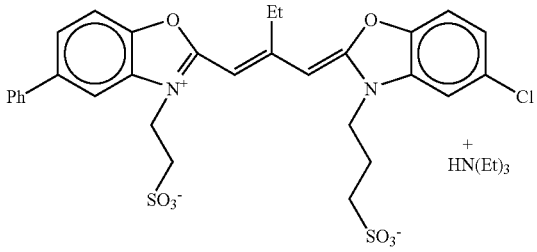

ExS-6

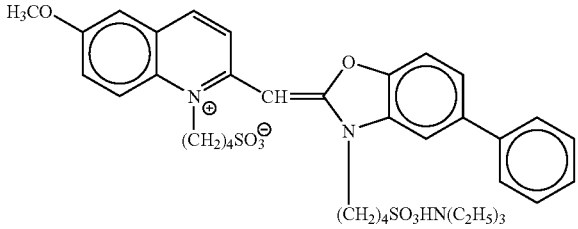

ExS-7

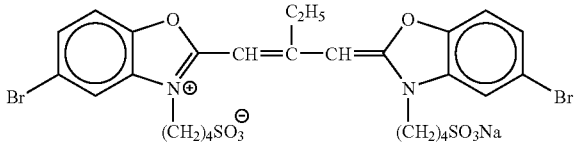

ExS-8

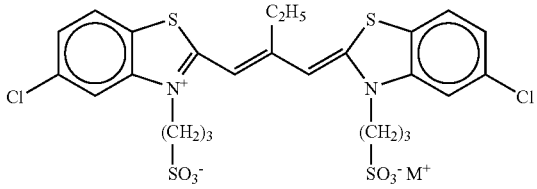

-continued
ExS-9
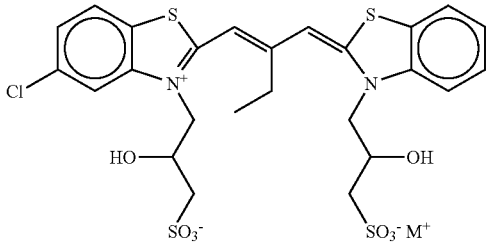
ExS-10
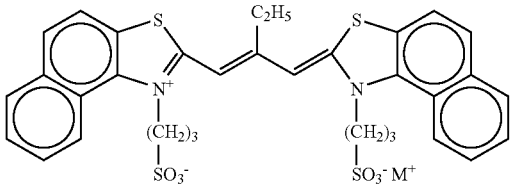
Compound 1
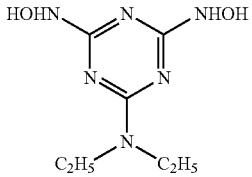
Compound 2
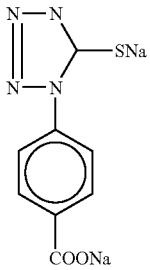
Compound 3
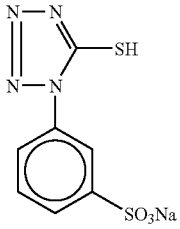
ExC-1
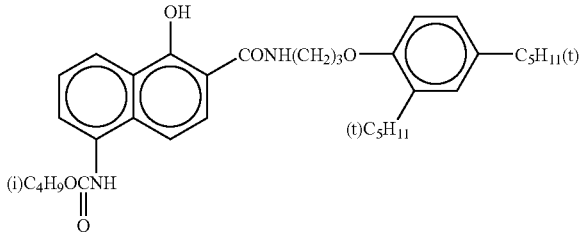
ExC-2
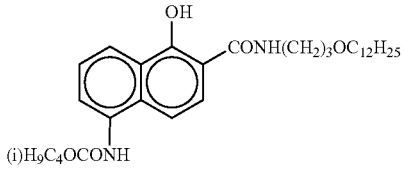
ExC-3
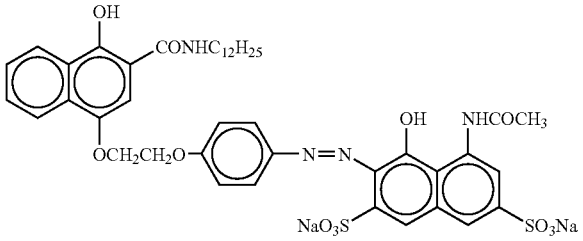
ExC-4
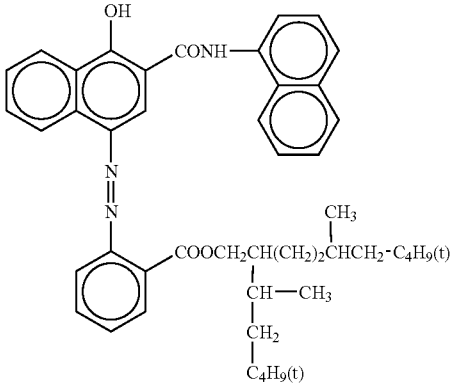
ExC-5
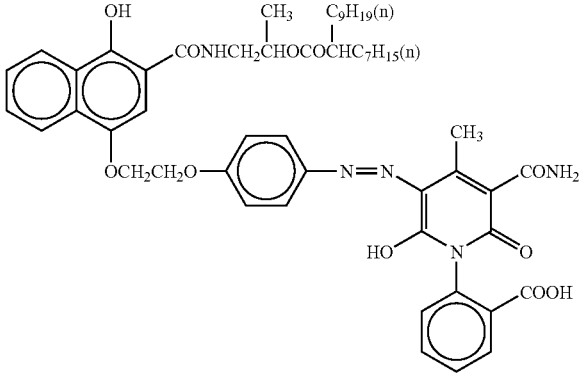

-continued
ExM-1
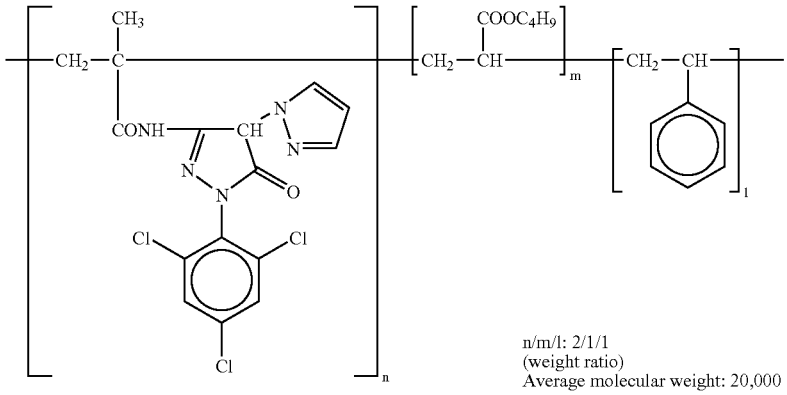
ExM-2
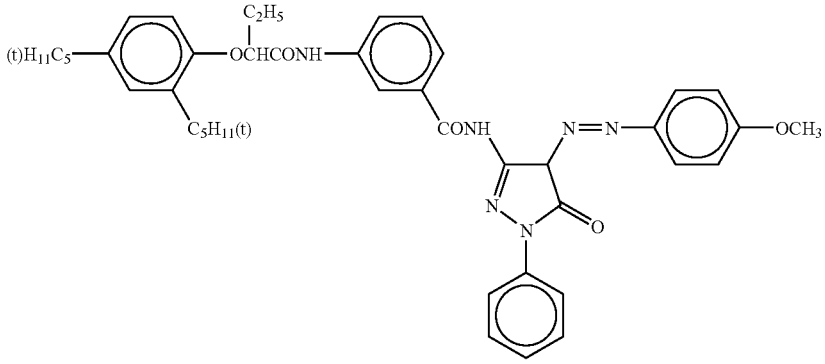
ExM-3
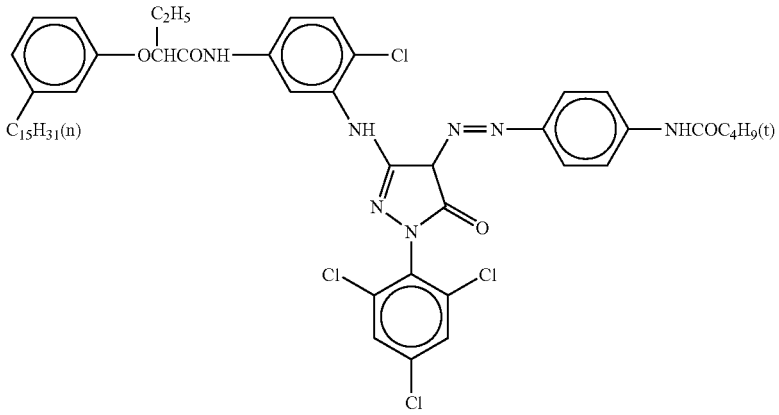
ExM-4
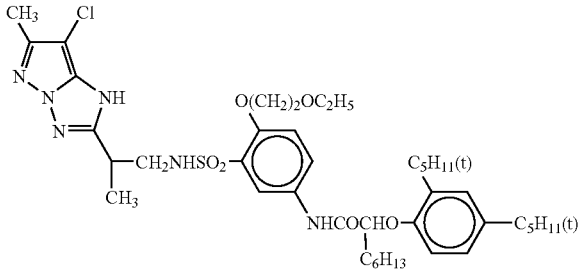
ExY-1
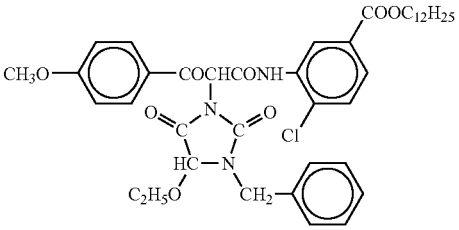

-continued
ExY-2
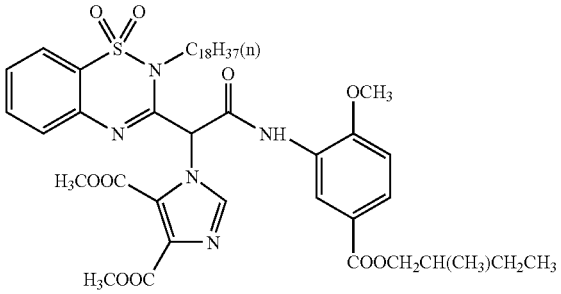
Solv-1
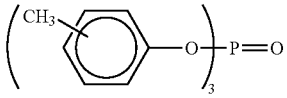
Solv-2
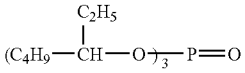
Cpd-1
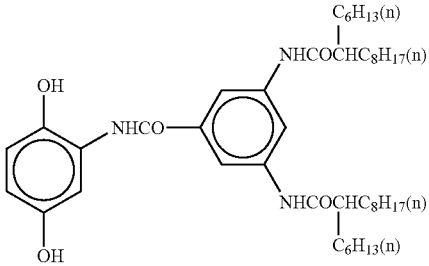
Cpd-2
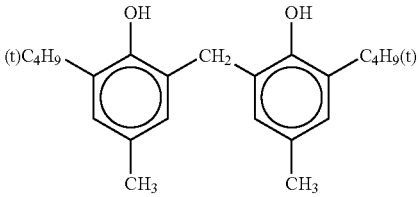
Cpd-3
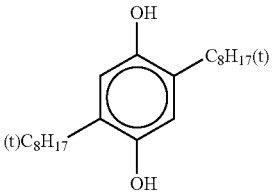
Cpd-4
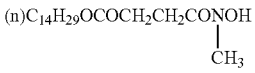
Cpd-5
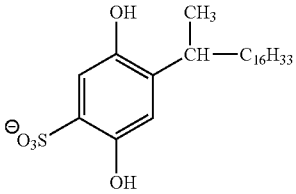
Cpd-6
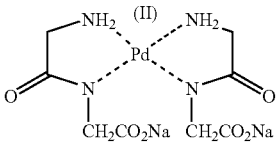
Cpd-7
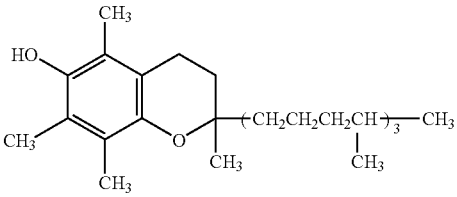
B-1
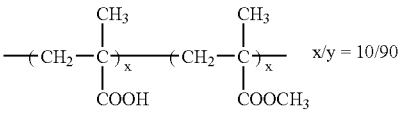
x/y = 10/90
B-2
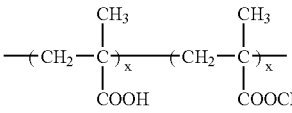
x/y = 40/60
B-3
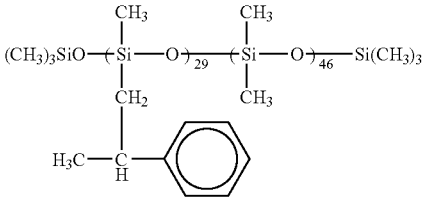
B-4
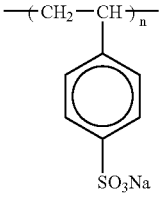

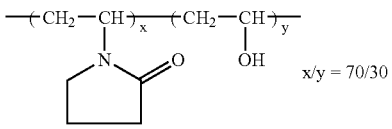
x/y = 70/30
-continued
B-5
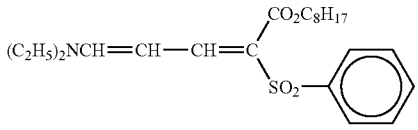
UV-1
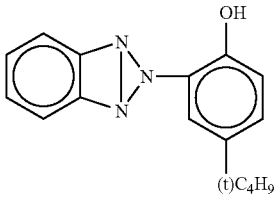
UV-2
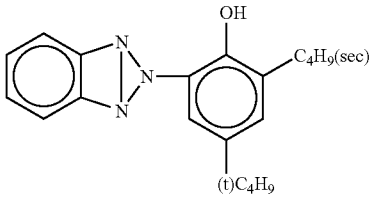
UV-3
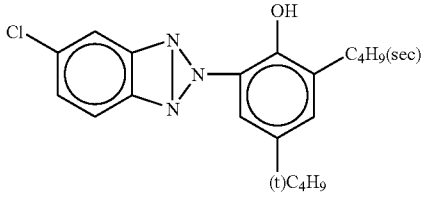
UV-4
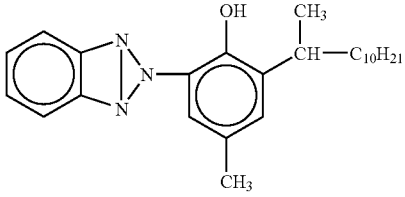
UV-5
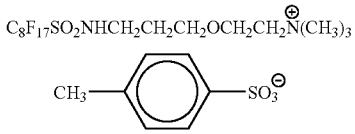
W-1
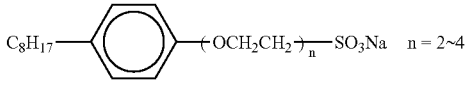
W-2
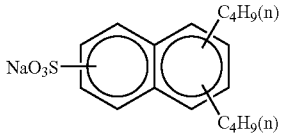
W-3
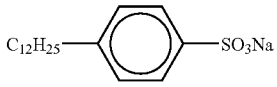
W-4
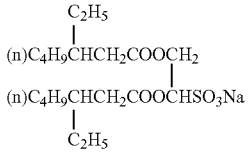
W-5
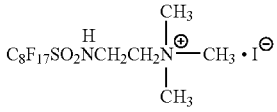
W-6
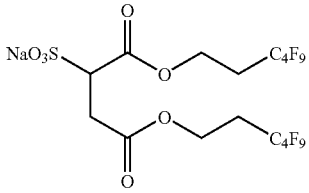
W-7
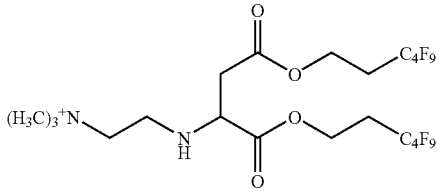
W-8
$nC_{10}H_{21}O-(CH_2CH_2O)_x-SO_3Na$
x = 1~3
W-9
$nC_{10}H_{21}O-(CH_2CH_2O)_z-C_4H_8SO_3Na$
z = 1~3
W-10
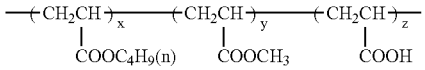
x/y/z: 20/60/20 (mass ratio)
Average molecular weight: about 36,000
W-11
$C_{11}H_{23}-CH=CH-CH_2-SO_3Na$ 60%
$C_{11}H_{23}-CH(OH)=CH-CH_2-SO_3Na$ 40%
W-12
$HO-(CH(CH_3)CH_2O)_{26-5}-(CH_2CH_2O)_{85-3}-(CH_2CH(CH_3)O)_{26-5}-H$
W-13
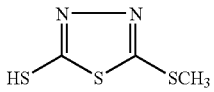
F-1

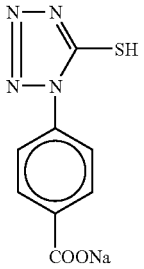
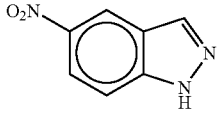
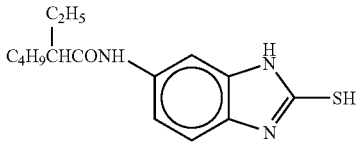
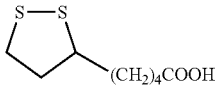
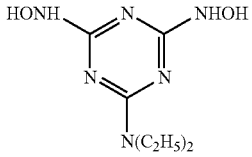
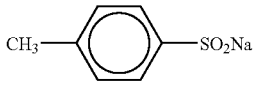
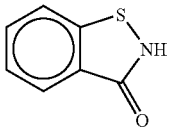
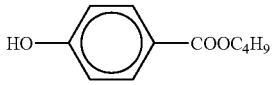
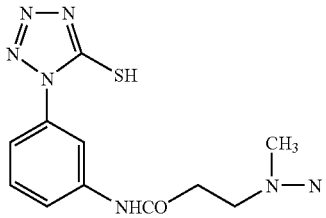
-continued
F-2
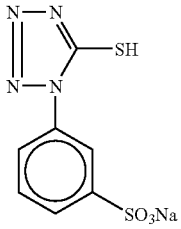
F-3
F-4
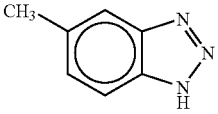
F-5
F-6
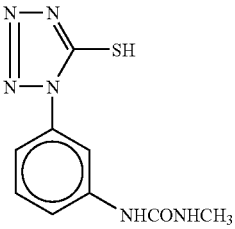
F-7
F-8
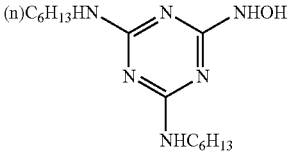
F-9
F-11
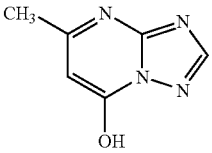
F-12
F-13
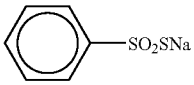
F-14
F-15
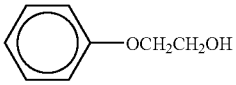
F-16
F-17
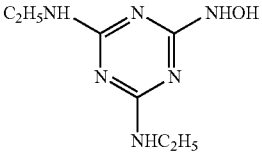
F-18
F-19
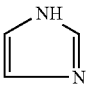
F-20

-continued
F-21
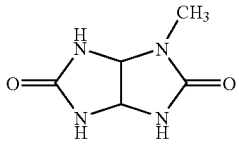
ExF-1
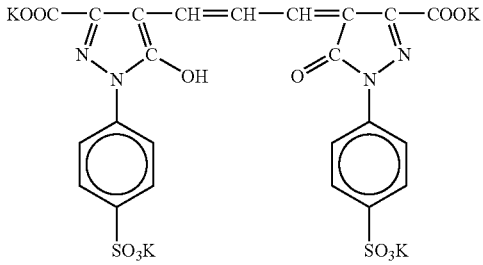
ExF-2
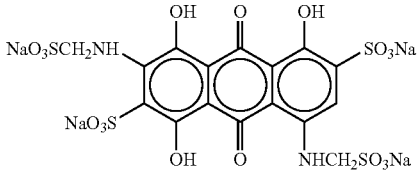
ExF-3
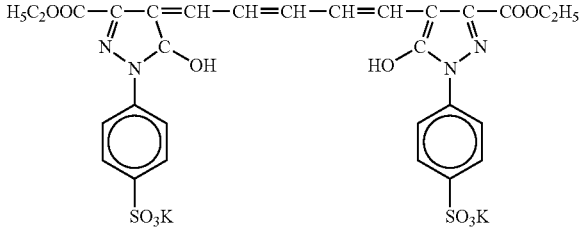
ExF-4
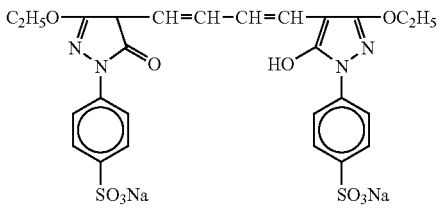
ExF-5
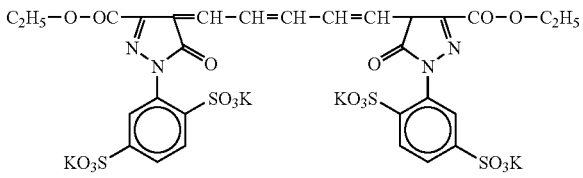
ExF-6
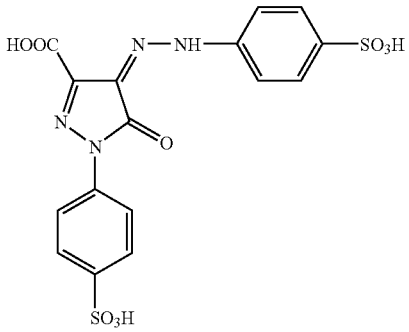
ExF-7
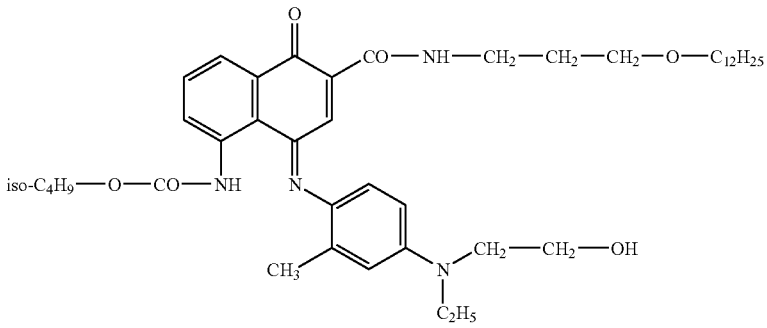

-continued

ExF-8

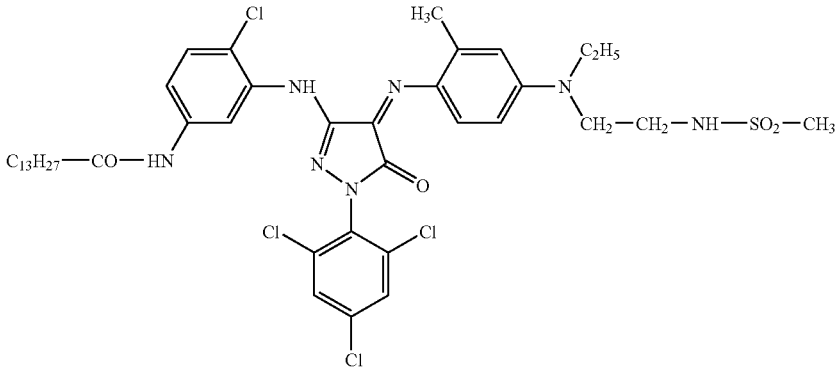

ExF-9

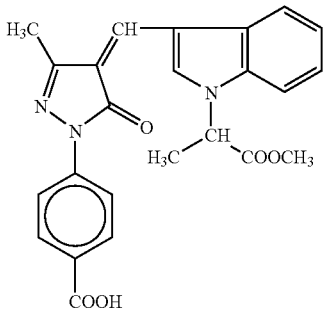

H-1

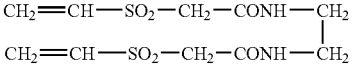

Samples 102, 103 and 104 were manufactured in the same manner as in the manufacture of Sample 101, except for increasing the coating amounts of silver in the $3^{rd}$ to $5^{th}$ layers, the $7^{th}$ to $9^{th}$ layers, and the $11^{th}$ to $13^{th}$ layers by 1.1 times, 1.2 times, and 1.3 times the amounts in Sample 101, respectively.

Sample 105 was manufactured in the same manner as in the manufacture of Sample 104, except for decreasing the coating amount of Cpd-1 in the $6^{th}$ and $10^{th}$ layers by 0.5 times the amount in Sample 104.

Sample 106 was manufactured in the same manner as in the manufacture of Sample 101, except for increasing the coating amount of silver in the $3^{rd}$ to $5^{th}$ layers, the $7^{th}$ to $9^{th}$ layers, and the $11^{th}$ to $13^{th}$ layers by 1.4 times the amounts in Sample 101, and decreasing the coating amount of Cpd-1 in the $6^{th}$ and $10^{th}$ layers by 0.3 times the amounts in Sample 101.

Blotting and color purity were evaluated according to the method described above in the specification after exposure with B, G, R lasers, and development processing. The results obtained are shown in Table A below.

TABLE A

| Experiment No. | Sample No. | Number of Pixels | Resolution (dpi) | Blotting [k/(D − 0.2)²] Dmin + 1.0 B | G | R | Dmin + 2.0 B | G | R | Color Purity (Dmax) B | G | R | Functional Evaluation Sharpness Negative Image | Positive Image | Color Saturation |
|---|---|---|---|---|---|---|---|---|---|---|---|---|---|---|---|
| 1 (Comp.) | 101 | 1,024 × 778 | $1.3 \times 10^3$ | 4.5 | 4.6 | 4.7 | 5.1 | 5.1 | 5.4 | 95 | 95 | 94 | 1.2 | 1.1 | 3.2 |
| 2 (Comp.) | 102 | 1,024 × 778 | $1.3 \times 10^3$ | 5.1 | 5.3 | 5.3 | 6.0 | 6.1 | 6.1 | 95 | 94 | 96 | 0.9 | 0.9 | 3.2 |
| 3 (Comp.) | 103 | 1,024 × 778 | $1.3 \times 10^3$ | 5.8 | 5.9 | 6.1 | 7.2 | 7.3 | 7.4 | 93 | 94 | 93 | 0.6 | 0.7 | 3.0 |
| 4 (Comp.) | 104 | 1,024 × 778 | $1.3 \times 10^3$ | 7.1 | 7.1 | 7.3 | 7.9 | 8.1 | 8.4 | 93 | 93 | 91 | 0.4 | 0.5 | 3.0 |
| 5 (Comp.) | 105 | 1,024 × 778 | $1.3 \times 10^3$ | 7.1 | 7.2 | 7.3 | 7.9 | 8.2 | 8.4 | 79 | 80 | 78 | 0.4 | 0.4 | 0.9 |
| 6 (Comp.) | 106 | 1,024 × 778 | $1.3 \times 10^3$ | 8.6 | 8.7 | 8.7 | 9.8 | 9.9 | 9.9 | 68 | 66 | 69 | 0.1 | 0.1 | 0.3 |
| 7 (Inv.) | 101 | 2,048 × 1,556 | $2.6 \times 10^3$ | 4.6 | 4.6 | 4.8 | 5.0 | 5.1 | 5.4 | 96 | 97 | 96 | 5.5 | 5.6 | 3.3 |
| 8 (Inv.) | 102 | 2,048 × 1,556 | $2.6 \times 10^3$ | 5.1 | 5.2 | 5.4 | 6.1 | 6.1 | 6.3 | 95 | 96 | 95 | 4.5 | 4.6 | 3.3 |
| 9 (Inv.) | 103 | 2,048 × 1,556 | $2.6 \times 10^3$ | 5.7 | 5.8 | 6.0 | 7.1 | 7.4 | 7.4 | 96 | 96 | 96 | 3.8 | 3.7 | 3.1 |
| 10 (Inv.) | 104 | 2,048 × 1,556 | $2.6 \times 10^3$ | 7.1 | 7.3 | 7.3 | 7.9 | 8.3 | 8.4 | 94 | 95 | 93 | 3.0 | 3.0 | 3.0 |
| 11 (Inv.) | 105 | 2,048 × 1,556 | $2.6 \times 10^3$ | 7.1 | 7.2 | 7.4 | 7.8 | 8.2 | 8.5 | 80 | 81 | 79 | 2.8 | 2.9 | 0.9 |
| 12 (Comp.) | 106 | 2,048 × 1,556 | $2.6 \times 10^3$ | 8.7 | 8.8 | 8.9 | 9.7 | 9.8 | 9.9 | 69 | 66 | 67 | 1.1 | 1.1 | 0.3 |

The contents of color development processing used in the development process of Samples 101 to 106 are as follows.

| Processing | Temperature (° C.) | Time |
|---|---|---|
| (1) Prebath | 27 ± 1 | 10 sec |
| (2) Elimination of backing and spray washing | 27–38 | 5 sec |
| (3) Color development | 41.1 ± 0.1 | 3 min |
| (4) Stopping | 27–38 | 30 sec |
| (5) Water washing | 27–38 | 30 sec |
| (6) Bleaching | 27 ± 1 | 3 min |
| (7) Water washing | 27–38 | 1 min |
| (8) Fixing | 38 ± 1 | 2 min |
| (9) Water washing | 27–38 | 2 min |
| (10) Stabilization | 27–38 | 10 sec |

The prescriptions of the processing solutions used in the processing steps are as follows.

Prescription of each processing solution:

| | Prescription |
|---|---|
| (1) Prebath | |
| Water at 27 to 38° C. | 800 ml |
| Borax (decahydrate) | 20.0 g |
| Sodium sulfate (anhydrous) | 100 g |
| Sodium hydroxide | 1.0 g |
| Water to make | 1.00 liter |
| pH (at 27° C.) | 9.25 |
| (3) Color development | |
| Water at 21 to 38° C. | 850 ml |
| Kodak Anticalcium No. 4 | 2.0 ml |
| Sodium sulfite (anhydrous) | 2.0 g |
| Eastman Antifog No. 9 | 0.22 g |
| Sodium bromide (anhydrous) | 1.20 g |
| Sodium carbonate (anhydrous) | 25.6 g |
| Sodium bicarbonate | 2.7 g |
| Color developing reagent 4-Amino-3-methyl-N-ethyl-N-(β-methane-sulfonamidoethyl)-aniline | 4.0 g |
| Water to make | 1.00 liter |
| pH (at 27° C.) | 10.20 |
| (4) Stopping | |
| Water at 21 to 38° C. | 900 ml |
| 7.0 N sulfuric acid | 50 ml |
| Water to make | 1.00 liter |
| pH (at 27° C.) | 0.9 |
| (6) Bleaching | |
| Water at 24 to 38° C. | 700 ml |
| Proxel GXL | 0.07 ml |
| Kodak Chelating Agent No. 1 | 24.2 g |
| 28% Ammonium hydroxide | 30.0 ml |
| Ammonium bromide | 32.5 g |
| Glacial acetic acid | 10.0 ml |
| Ferric nitrate (nonahydrate) | 28.8 g |
| Water to make | 1.0 liter |
| pH (at 27° C.) | 5.0 ± 0.2 |
| (8) Fixing | |
| Water at 20 to 38° C. | 700 ml |
| Kodak Anticalcium No. 4 | 2.0 ml |
| A 58% ammonium thiosulfate solution | 185 ml |
| Sodium sulfite (anhydrous) | 10.0 g |
| Sodium bisulfite (anhydrous) | 8.4 g |
| Water to make | 1.0 liter |
| pH (at 27° C.) | 6.5 |

-continued

Prescription of each processing solution:

| | Prescription |
|---|---|
| (10) Stabilization | |
| Water at 21 to 27° C. | 1.00 liter |
| Kodak Stabilizer Additive | 0.14 ml |
| Formaldehyde (a 37.5% solution) | 1.5 ml |

The functional evaluations of the image quality of Samples 101 to 106 were carried out as follows.

The images of a landscape having digital data of pixels of (1,024×778) and (2,048×1,556) were exposed on Samples 101 to 105 in the size of 0.8×0.6 inches with B, G, R lasers, and the obtained negative images were screened and appreciated by twenty panelists. Evaluation was performed by relative evaluation with the evaluation value of the time using pixels of (1,024×778) and Sample 104 being 3 (standard). Further, the negative images were exposed on Fuji Color Positive Film F-CP, and development processed according to the method described in FUJI FILM PROCESSING MANUAL, Motion Picture Films to obtain positive images. The obtained images were screened and evaluated in the same manner as above.

Sharpness was evaluated as to the negative images, and sharpness and color saturation as to the positive images by the following seven grades, and the values of evaluation by twenty panelists were averaged. The results-obtained are shown in Table A.

0: Very inferior
1: Inferior
2: A little inferior
3: Standard
4: A little superior
5: Superior
6: Very superior From the results shown in Table A, it can be seen that motion picture images excellent in sharpness and color saturation can be obtained by adopting the image-recording method of the invention.

Example 2

Sample 201 was manufactured in the same manner as in the manufacture of Sample 101, except for increasing the coating amounts of ExF-4 in the $2^{nd}$ layer, ExF-5 and ExF-7 in the $6^{th}$ layer, ExF-8 in the $10^{th}$ layer, ExF-1 and ExF-9 in the $14^{th}$ layer by 1.1 times the respective amounts in Sample 101. In the next place, Samples 202, 203 and 204 were manufactured in the manufacture of Sample 201, except for increasing the coating amounts of silver in the $3^{rd}$ to $5^{th}$ layers, the $7^{th}$ to $9^{th}$ layers, and the $11^{th}$ to $13^{th}$ layers by 1.1 times, 1.2 times, and 1.3 times the amounts in Sample 201, respectively.

Sample 205 was manufactured in the manufacture of Sample 204, except for decreasing the coating amount of Cpd-1 in the $6^{th}$ and $10^{th}$ layers by 0.5 times the amount in Sample 204.

Sample 206 was manufactured in the same manner as in the manufacture of Sample 201, except for increasing the coating amount of silver in the $3^{rd}$ to $5^{th}$ layers, the $7^{th}$ to $9^{th}$ layers, and the $11^{th}$ to $13^{th}$ layers by 1.4 times the amounts in Sample 201, and decreasing the coating amount of Cpd-1 in the $6^{th}$ and $10^{th}$ layers by 0.3 times the amounts in Sample 201.

The results of evaluations of blotting and color purity are shown in Table B below.

The methods of evaluations of blotting and color purity, and the methods of functional evaluations are the same as in Example 1.

TABLE B

| Experiment No. | Sample No. | Number of Pixels | Resolution (dpi) | Blotting [k/(D − 0.2)$^2$] Dmin + 1.0 B | G | R | Dmin + 2.0 B | G | R | Color Purity (Dmax) B | G | R | Functional Evaluation Sharpness Negative Image | Positive Image | Color Saturation |
|---|---|---|---|---|---|---|---|---|---|---|---|---|---|---|---|
| 1 (Comp.) | 201 | 1,024 × 778 | $1.3 \times 10^3$ | 3.0 | 3.1 | 3.1 | 3.3 | 3.4 | 3.4 | 95 | 95 | 94 | 1.1 | 1.1 | 3.1 |
| 2 (Comp.) | 202 | 1,024 × 778 | $1.3 \times 10^3$ | 3.4 | 3.5 | 3.6 | 3.8 | 3.8 | 3.9 | 95 | 94 | 96 | 1.0 | 0.9 | 3.1 |
| 3 (Comp.) | 203 | 1,024 × 778 | $1.3 \times 10^3$ | 3.6 | 3.7 | 3.6 | 4.3 | 4.4 | 4.4 | 93 | 94 | 94 | 0.7 | 0.7 | 2.9 |
| 4 (Comp.) | 204 | 1,024 × 778 | $1.3 \times 10^3$ | 4.1 | 4.2 | 4.2 | 5.0 | 5.1 | 5.2 | 93 | 92 | 91 | 0.5 | 0.6 | 3.0 |
| 5 (Comp.) | 205 | 1,024 × 778 | $1.3 \times 10^3$ | 4.2 | 4.1 | 4.2 | 5.1 | 5.1 | 5.2 | 79 | 79 | 78 | 0.4 | 0.5 | 0.8 |
| 6 (Comp.) | 206 | 1,024 × 778 | $1.3 \times 10^3$ | 5.2 | 5.2 | 5.3 | 6.0 | 6.1 | 6.1 | 68 | 65 | 69 | 0.2 | 0.1 | 0.2 |
| 7 (Inv.) | 201 | 2,048 × 1,556 | $2.6 \times 10^3$ | 3.0 | 3.1 | 3.0 | 3.3 | 3.3 | 3.3 | 96 | 96 | 96 | 5.6 | 5.8 | 3.3 |
| 8 (Inv.) | 202 | 2,048 × 1,556 | $2.6 \times 10^3$ | 3.3 | 3.5 | 3.5 | 3.7 | 3.8 | 3.8 | 96 | 95 | 95 | 4.6 | 4.6 | 3.2 |
| 9 (Inv.) | 203 | 2,048 × 1,556 | $2.6 \times 10^3$ | 3.6 | 3.6 | 3.6 | 4.2 | 4.3 | 4.4 | 95 | 96 | 96 | 3.9 | 3.8 | 3.0 |
| 10 (Inv.) | 204 | 2,048 × 1,556 | $2.6 \times 10^3$ | 4.1 | 4.1 | 4.2 | 5.0 | 5.0 | 5.1 | 94 | 96 | 94 | 3.0 | 3.1 | 3.0 |
| 11 (Inv.) | 205 | 2,048 × 1,556 | $2.6 \times 10^3$ | 4.1 | 4.2 | 4.2 | 5.1 | 5.2 | 5.2 | 81 | 80 | 79 | 2.9 | 2.9 | 0.9 |
| 12 (Comp.) | 206 | 2,048 × 1,556 | $2.6 \times 10^3$ | 5.1 | 5.3 | 5.2 | 6.0 | 6.0 | 6.1 | 68 | 65 | 67 | 1.0 | 1.1 | 0.2 |

From the results shown in Table B, it can be seen that motion picture images excellent in sharpness and color saturation can be obtained by adopting the image-recording method of the invention.

Example 3

Preparation of Emulsions Em-J, K, M, N and P:

Emulsions Em-J, K, M, N and P were manufactured in the same manner as in the manufacture of Emulsion Em-A, except for arbitrarily changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization.

Preparation of Emulsions Em-L, O, Q and R:

Emulsions Em-L, O, Q and R were manufactured in the same manner as in the manufacture of Emulsion Em-C, except for arbitrarily changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization.

The characteristic values of the obtained emulsions are shown in Table 2 below.

TABLE 2

| Name of Emulsion | Grain Form | Average Equivalent-Sphere Diameter (μm) | Coefficient of Variation (%) | Content of I (mol %) | Content of Cl (mol %) | Sensitizing Dye (addition amount) |
|---|---|---|---|---|---|---|
| Em-J | Cubic | 0.18 | 11 | 3.0 | 1 | ExS-1 ($1.0 \times 10^{-4}$)<br>ExS-2 ($5.3 \times 10^{-4}$)<br>ExS-3 ($4.0 \times 10^{-4}$) |
| Em-K | Cubic | 0.13 | 12 | 2.9 | 0 | ExS-1 ($1.5 \times 10^{-4}$)<br>ExS-2 ($7.5 \times 10^{-4}$)<br>ExS-3 ($6.2 \times 10^{-6}$) |
| Em-L | Cubic | 0.10 | 13 | 2.6 | 0.5 | ExS-1 ($2.2 \times 10^{-4}$)<br>ExS-2 ($1.0 \times 10^{-3}$)<br>ExS-3 ($8.0 \times 10^{-4}$) |
| Em-M | Cubic | 0.40 | 12 | 3.2 | 0.5 | ExS-4 ($2.7 \times 10^{-4}$)<br>ExS-5 ($2.5 \times 10^{-4}$)<br>ExS-6 ($2.7 \times 10^{-4}$)<br>ExS-7 ($2.5 \times 10^{-4}$) |
| Em-N | Cubic | 0.12 | 12 | 2.8 | 0 | ExS-4 ($4.1 \times 10^{-4}$)<br>ExS-5 ($4.0 \times 10^{-4}$)<br>ExS-6 ($4.3 \times 10^{-4}$)<br>ExS-7 ($4.0 \times 10^{-4}$) |
| Em-O | Cubic | 0.07 | 14 | 2.1 | 0 | ExS-4 ($2.2 \times 10^{-4}$)<br>ExS-5 ($2.3 \times 10^{-4}$)<br>ExS-6 ($2.2 \times 10^{-4}$)<br>ExS-7 ($2.1 \times 10^{-4}$) |

TABLE 2-continued

| Name of Emulsion | Grain Form | Average Equivalent-Sphere Diameter (μm) | Coefficient of Variation (%) | Content of I (mol %) | Content of Cl (mol %) | Sensitizing Dye (addition amount) |
|---|---|---|---|---|---|---|
| Em-P | Cubic | 0.11 | 13 | 2.8 | 1 | ExS-8 ($1.1 \times 10^{-3}$)<br>ExS-9 ($3.0 \times 10^{-4}$)<br>ExS-10 ($1.5 \times 10^{-4}$) |
| Em-Q | Cubic | 0.08 | 14 | 2.1 | 0 | ExS-8 ($1.4 \times 10^{-3}$)<br>ExS-9 ($4.5 \times 10^{-4}$)<br>ExS-10 ($2.3 \times 10^{-4}$) |
| Em-R | Cubic | 0.07 | 14 | 2.1 | 0 | ExS-8 ($6.8 \times 10^{-4}$)<br>ExS-9 ($1.6 \times 10^{-4}$)<br>ExS-10 ($9.0 \times 10^{-5}$) |

* The coefficient of variation is the coefficient of variation of the equivalent-sphere diameters.
* In the parentheses of each of the compounds of sensitizing dyestuffs is the addition amount (unit: mol/mol Ag).

Manufacture of Multilayer Color Photographic Material Sample 301:

Each layer having the composition shown below was coated on a support having a backing layer and an undercoat layer similar to the support in Sample 101 to manufacture a multilayer color photographic material sample 301.

Composition of Photographic Material:

The coating amounts of the silver halide and colloidal silver were shown as the coating amount of silver in the unit of $g/m^2$, and the amounts of the coupler, additive and gelatin were shown in the unit of $g/m^2$.

First layer: antihalation layer

| | |
|---|---|
| Black colloidal silver | 0.038 as silver |
| Silver iodobromide emulsion grains (average equivalent-sphere diameter: 0.07 μm, silver iodide content: 2 mol %) | 0.025 as silver |
| Gelatin | 0.908 |

Second layer: intermediate layer

| | |
|---|---|
| Gelatin | 2.150 |
| ExF-4 | 0.690 |

Third layer: low sensitivity red-sensitive emulsion layer

| | |
|---|---|
| Em-R | 0.110 as silver |
| Gelatin | 1.745 |
| ExC-1 | 0.110 |
| ExC-2 | 0.164 |
| ExC-3 | 0.035 |
| ExC-4 | 0.036 |
| Cpd-2 | 0.092 |
| Solv-1 | 0.380 |

Fourth layer: middle sensitivity red-sensitive emulsion layer

| | |
|---|---|
| Em-Q | 0.155 as silver |
| Gelatin | 0.670 |
| ExC-1 | 0.045 |
| ExC-2 | 0.050 |
| ExC-3 | 0.020 |
| ExC-4 | 0.003 |
| Cpd-2 | 0.065 |
| Solv-1 | 0.170 |

Fifth layer: high sensitivity red-sensitive emulsion layer

| | |
|---|---|
| Em-P | 0.190 as silver |
| Gelatin | 1.400 |

-continued

| | |
|---|---|
| ExC-1 | 0.110 |
| ExC-2 | 0.153 |
| ExC-4 | 0.005 |
| Cpd-2 | 0.050 |
| Solv-1 | 0.330 |

Sixth layer: intermediate layer

| | |
|---|---|
| Gelatin | 1.489 |
| Cpd-1 | 0.069 |
| ExF-5 | 0.074 |
| Solv-1 | 0.239 |

Seventh layer: low sensitivity green-sensitive emulsion layer

| | |
|---|---|
| Em-O | 0.324 as silver |
| Gelatin | 1.690 |
| ExM-1 | 0.339 |
| ExM-3 | 0.112 |
| Solv-1 | 0.499 |
| Solv-2 | 0.052 |

Eighth layer: middle sensitivity green-sensitive emulsion layer

| | |
|---|---|
| Em-N | 0.175 as silver |
| Gelatin | 0.502 |
| ExM-1 | 0.090 |
| ExM-2 | 0.038 |
| ExM-3 | 0.025 |
| Solv-1 | 0.162 |
| Solv-2 | 0.017 |

Ninth layer: high sensitivity green-sensitive emulsion layer

| | |
|---|---|
| Em-M | 0.231 as silver |
| Gelatin | 0.410 |
| ExM-1 | 0.070 |
| ExM-2 | 0.028 |
| ExM-3 | 0.019 |
| Solv-1 | 0.135 |
| Solv-2 | 0.009 |

Tenth layer: yellow filter layer

| | |
|---|---|
| Yellow colloidal silver | 0.058 as silver |
| Gelatin | 0.950 |
| Cpd-1 | 0.105 |
| Solid dispersion dye ExF-7 | 0.135 |
| Solv-1 | 0.121 |

-continued

| Eleventh layer: low sensitivity blue-sensitive emulsion layer | |
|---|---|
| Em-L | 0.105 as silver |
| Em-K | 0.030 as silver |
| Gelatin | 1.514 |
| ExY-1 | 0.056 |
| ExY-2 | 0.580 |
| ExC-2 | 0.008 |
| Solv-1 | 0.260 |

| Twelfth layer: middle sensitivity blue-sensitive emulsion layer | |
|---|---|
| Em-K | 0.120 as silver |
| Gelatin | 0.859 |
| ExY-1 | 0.039 |
| ExY-2 | 0.373 |
| Solv-1 | 0.159 |

| Thirteenth layer: high sensitivity blue-sensitive emulsion layer | |
|---|---|
| Em-J | 0.122 as silver |
| Em-K | 0.152 as silver |
| Gelatin | 0.374 |
| ExY-1 | 0.010 |
| ExY-2 | 0.121 |
| Solv-1 | 0.060 |

| Fourteenth layer: first protective layer | |
|---|---|
| Silver iodobromide emulsion grains (average equivalent-sphere diameter: 0.07 μm, silver iodide content: 2 mol %) | 0.200 as silver |
| Gelatin | 0.683 |
| Solid dispersion dye ExF-7 | 0.054 |
| ExF-1 | 0.073 |
| H-1 | 0.160 |

-continued

| Fifteenth layer: second protective layer | |
|---|---|
| Gelatin | 0.727 |
| B-1 (diameter: 2.0 μm) | 0.007 |
| B-2 (diameter: 2.0 μm) | 0.005 |
| B-3 | 0.047 |
| H-1 | 0.170 |

To the thus manufactured Sample 301 were added 1,2-benzisothiazolin-3-one (200 ppm on average to gelatin), n-butyl-p-hydroxybenzoate (about 1,000 ppm, the same as above), and 2-phenoxyethanol (about 10,000 ppm, the same as above), in addition to the above.

Cpd-3 to Cpd-7, B-4, B-5, W-1 to W-13, F-1 to F-21, ExF-2, ExF-3, ExF-6, UV-1 to UV-5 were further added.

Emulsions Em-a, Em-b and Em-c were prepared in the same manner as in the preparation of Emulsion Em-P in the fifth layer of Sample 301 so as to reach almost the same sensitivity as that of Em-M, except for arbitrarily changing the temperature of the solution in the reaction vessel, the compositions and concentrations of Solutions A to E, the addition rates of Solutions B to E, pBr of the solution in the reaction vessel, the addition amounts of thiourea dioxide, sodium benzene-sulfonate, and $K_2IrCl_6$, the kinds of the sensitizing dyestuffs after desalting, and the condition of chemical sensitization. The characteristic values of the prepared emulsions are shown in Table 3 below.

TABLE 3

| Name of Emulsion | Grain Form | Average Equivalent-Sphere Diameter (μm) | Coefficient of Variation (%) | Content of I (mol %) | Content of Cl (mol %) | Sensitizing Dye (addition amount) |
|---|---|---|---|---|---|---|
| Em-a | Cubic | 0.33 | 14 | 3.5 | 1 | ExS-4 ($8.2 \times 10^{-5}$) |
| | | | | | | ExS-5 ($8.0 \times 10^{-5}$) |
| | | | | | | ExS-6 ($8.2 \times 10^{-5}$) |
| | | | | | | ExS-7 ($8.0 \times 10^{-5}$) |
| Em-b | Cubic | 0.28 | 14 | 3.5 | 1 | ExS-4 ($9.5 \times 10^{-5}$) |
| | | | | | | ExS-5 ($9.1 \times 10^{-5}$) |
| | | | | | | ExS-6 ($9.5 \times 10^{-5}$) |
| | | | | | | ExS-7 ($9.1 \times 10^{-5}$) |
| Em-c | Cubic | 0.18 | 15 | 3.5 | 1 | ExS-4 ($1.5 \times 10^{-4}$) |
| | | | | | | ExS-5 ($1.0 \times 10^{-4}$) |
| | | | | | | ExS-6 ($1.5 \times 10^{-4}$) |
| | | | | | | ExS-7 ($1.0 \times 10^{-4}$) |

* The coefficient of variation is the coefficient of variation of the equivalent-sphere diameters.
* In the parentheses of each of the compounds of sensitizing dyestuffs. is the addition amount (unit: mol/mol Ag).

Photographic material samples 302 to 306 were manufactured by the addition of fixed dyes to the $3^{rd}$ layer to $10^{th}$ layer of Sample 301 as shown in Table C below. When dye D-34 was added to the $3^{rd}$ to $5^{th}$ layers, the addition amounts of ExC-1 and ExC-2 were adjusted so that the gradations of the red-sensitive layers were equivalent to those of Sample 303.

Samples 307 to 324 were manufactured on the basis of Samples 301 to 306, except for changing the emulsion used in the $9^{th}$ layer to Em-a to Em-c as shown in Table C.

Evaluation of Blotting k and Color Purity:

A digital data of pixels of (2,048×1,556) was exposed in the size of 0.8×0.6 inches with B, G, R lasers, and then development processed. Blotting and color purity were evaluated according to the methods described above in the specification. The results of blotting of G, color reproduction, and functional evaluations of the image of a landscape are shown in Table C below.

TABLE C

| Experiment No. | Sample No. | Emulsion in Ninth Layer | Magenta Dye: Addition Layer | Magenta Dye: Dye | Magenta Dye: Addition Amount (g/m$^2$) | Variation Width of Green Sensitivity |
|---|---|---|---|---|---|---|
| 1 (Comparison) | 301 | Em-M | — | — | — | Control |
| 2 (Comparison) | 302 | Em-M | 8$^{th}$ layer | D-8 | 0.061 | −0.03 |
| 3 (Comparison) | 303 | Em-M | 7$^{th}$ layer | D-8 | * | −0.05 |
| | | | 9$^{th}$ layer | D-8 | 0.061 | |
| 4 (Invention) | 304 | Em-M | 3$^{rd}$ layer | D-34 | 0.013 | −0.02 |
| | | | 4$^{th}$ layer | D-34 | 0.004 | |
| | | | 5$^{th}$ layer | D-34 | 0.030 | |
| | | | 6$^{th}$ layer | D-8 | 0.061 | |
| 5 (Invention) | 305 | Em-M | 10$^{th}$ layer | D-8 | 0.061 | −0.02 |
| 6 (Invention) | 306 | Em-M | 3$^{rd}$ layer | D-34 | 0.010 | −0.03 |
| | | | 4$^{th}$ layer | D-34 | 0.003 | |
| | | | 5$^{th}$ layer | D-34 | 0.022 | |
| | | | 6$^{th}$ layer | D-8 | 0.032 | |
| | | | 10$^{th}$ layer | D-8 | 0.028 | |
| | | | 12$^{th}$ layer | D-34 | 0.009 | |
| | | | 13$^{th}$ layer | D-34 | 0.003 | |
| 7 (Comparison) | 307 | Em-a | — | — | — | 0.00 |
| 8 (Comparison) | 308 | Em-a | 8$^{th}$ layer | D-8 | 0.061 | −0.02 |

| Experiment No. | Blotting of Green [k/(D − 0.2)$^2$] Dmin + 1.0 | Blotting of Green [k/(D − 0.2)$^2$] Dmin + 2.0 | Color Purity of Green (Dmax) (%) | Functional Evaluation: Sharpness: Negative Image | Functional Evaluation: Sharpness: Positive Image | Functional Evaluation: Color Saturation | Processability: γC/γM | Processability: γY/γM |
|---|---|---|---|---|---|---|---|---|
| 1 (Comparison) | 5.1 | 5.8 | 75 | 3.0 | 3.0 | 3.0 | 1.05 | 1.04 |
| 2 (Comparison) | 4.6 | 5.2 | 75 | 3.3 | 3.3 | 3.1 | 1.04 | 1.04 |
| 3 (Comparison) | 4.5 | 5.0 | 74 | 3.5 | 3.5 | 3.0 | 1.05 | 1.03 |
| 4 (Invention) | 4.5 | 5.0 | 78 | 3.7 | 3.8 | 3.1 | 1.04 | 1.03 |
| 5 (Invention) | 4.5 | 4.9 | 75 | 3.7 | 3.6 | 2.9 | 1.03 | 1.04 |
| 6 (Invention) | 4.4 | 4.9 | 78 | 3.8 | 3.8 | 3.3 | 1.02 | 1.02 |
| 7 (Comparison) | 5.2 | 6.0 | 72 | 2.8 | 2.8 | 2.7 | 1.05 | 1.06 |
| 8 (Comparison) | 5.0 | 5.7 | 72 | 3.1 | 3.1 | 2.8 | 1.06 | 1.05 |

| Experiment No. | Sample No. | Emulsion in Ninth Layer | Magenta Dye: Addition Layer | Magenta Dye: Dye | Magenta Dye: Addition Amount (g/m$^2$) | Variation Width of Green Sensitivity |
|---|---|---|---|---|---|---|
| 9 (Comparison) | 309 | Em-a | 7$^{th}$ layer | D-8 | * | −0.06 |
| | | | 9$^{th}$ layer | D-8 | 0.061 | |
| 10 (Invention) | 310 | EM-a | 3$^{rd}$ layer | D-34 | 0.013 | −0.03 |
| | | | 4$^{th}$ layer | D-34 | 0.004 | |
| | | | 5$^{th}$ layer | D-34 | 0.030 | |
| | | | 6$^{th}$ layer | D-8 | 0.061 | |
| 11 (Invention) | 311 | Em-a | 10$^{th}$ layer | D-8 | 0.061 | −0.03 |
| 12 (Invention) | 312 | Em-a | 3$^{rd}$ layer | D-34 | 0.010 | −0.03 |
| | | | 4$^{th}$ layer | D-34 | 0.003 | |
| | | | 5$^{th}$ layer | D-34 | 0.022 | |
| | | | 6$^{th}$ layer | D-8 | 0.032 | |
| | | | 10$^{th}$ layer | D-8 | 0.028 | |
| | | | 12$^{th}$ layer | D-34 | 0.009 | |
| | | | 13$^{th}$ layer | D-34 | 0.003 | |
| 13 (Comparison) | 313 | Em-b | — | — | — | 0.00 |
| 14 (Comparison) | 314 | Em-b | 8$^{th}$ layer | D-8 | 0.061 | −0.02 |
| 15 (Comparison) | 315 | Em-b | 7$^{th}$ layer | D-8 | * | −0.05 |
| | | | 9$^{th}$ layer | D-8 | 0.061 | −0.05 |
| 16 (Invention) | 316 | Em-b | 3$^{rd}$ layer | D-34 | 0.013 | −0.03 |
| | | | 4$^{th}$ layer | D-34 | 0.004 | |
| | | | 5$^{th}$ layer | D-34 | 0.030 | |
| | | | 6$^{th}$ layer | D-8 | 0.061 | |

TABLE C-continued

| Experiment No. | Blotting of Green [k/(D − 0.2)$^2$] Dmin + 1.0 | Dmin + 2.0 | Color Purity of Green (Dmax) (%) | Functional Evaluation: Sharpness Negative Image | Positive Image | Color Saturation | Processability γC/γM | γY/γM |
|---|---|---|---|---|---|---|---|---|
| 9 (Comparison) | 4.7 | 5.2 | 72 | 3.3 | 3.3 | 2.8 | 1.06 | 1.05 |
| 10 (Invention) | 4.2 | 4.7 | 81 | 4.1 | 4.1 | 3.8 | 1.02 | 1.04 |
| 11 (Invention) | 3.9 | 4.4 | 73 | 4.5 | 4.5 | 2.9 | 1.04 | 1.04 |
| 12 (Invention) | 3.6 | 4.2 | 81 | 4.8 | 4.8 | 3.7 | 1.02 | 1.03 |
| 13 (Comparison) | 5.3 | 6.2 | 71 | 2.7 | 2.7 | 2.6 | 1.06 | 1.05 |
| 13 (Comparison) | 5.0 | 5.8 | 72 | 3.1 | 3.1 | 2.6 | 1.05 | 1.06 |
| 15 (Comparison) | 4.8 | 5.4 | 70 | 3.1 | 3.1 | 2.5 | 1.06 | 1.05 |
| 16 (Invention) | 3.7 | 4.1 | 86 | 4.7 | 4.7 | 4.5 | 1.02 | 1.03 |

| Experiment No. | Sample No. | Emulsion in Ninth Layer | Magenta Dye: Addition Layer | Dye | Addition Amount (g/m$^2$) | Variation Width of Green Sensitivity |
|---|---|---|---|---|---|---|
| 17 (Invention) | 317 | Em-b | 10$^{th}$ layer | D-8 | 0.061 | −0.02 |
| 18 (Invention) | 318 | Em-b | 3$^{rd}$ layer | D-34 | 0.010 | −0.03 |
| | | | 4$^{th}$ layer | D-34 | 0.003 | |
| | | | 5$^{th}$ layer | D-34 | 0.022 | |
| | | | 6$^{th}$ layer | D-8 | 0.032 | |
| | | | 10$^{th}$ layer | D-8 | 0.028 | |
| | | | 12$^{th}$ layer | D-34 | 0.009 | |
| | | | 13$^{th}$ layer | D-34 | 0.003 | |
| 19 (Comparison) | 319 | Em-c | — | — | — | 0.00 |
| 20 (Comparison) | 320 | Em-c | 8$^{th}$ layer | D-8 | 0.061 | −0.02 |
| 21 (Comparison) | 321 | Em-c | 7$^{th}$ layer | D-8 | * | −0.06 |
| | | | 9$^{th}$ layer | D-8 | 0.061 | |
| 22 (Invention) | 322 | Em-c | 3$^{rd}$ layer | D-34 | 0.013 | −0.03 |
| | | | 4$^{th}$ layer | D-34 | 0.004 | |
| | | | 5$^{th}$ layer | D-34 | 0.030 | |
| | | | 6$^{th}$ layer | D-8 | 0.061 | |
| 23 (Invention) | 323 | Em-c | 10$^{th}$ layer | D-8 | 0.061 | −0.03 |
| 24 (Invention) | 324 | Em-c | 3$^{rd}$ layer | D-34 | 0.010 | −0.02 |
| | | | 4$^{th}$ layer | D-34 | 0.003 | |
| | | | 5$^{th}$ layer | D-34 | 0.022 | |
| | | | 6$^{th}$ layer | D-8 | 0.032 | |
| | | | 10$^{th}$ layer | D-8 | 0.028 | |
| | | | 12$^{th}$ layer | D-34 | 0.009 | |
| | | | 13$^{th}$ layer | D-34 | 0.003 | |

| Experiment No. | Blotting of Green [k/(D − 0.2)$^2$] Dmin + 1.0 | Dmin + 2.0 | Color Purity of Green (Dmax) (%) | Functional Evaluation: Sharpness Negative Image | Positive Image | Color Saturation | Processability γC/γM | γY/γM |
|---|---|---|---|---|---|---|---|---|
| 17 (Invention) | 3.2 | 3.8 | 74 | 5.0 | 5.0 | 3.1 | 1.04 | 1.03 |
| 18 (Invention) | 2.8 | 3.3 | 88 | 5.4 | 5.4 | 4.8 | 1.02 | 1.02 |
| 19 (Comparison) | 5.5 | 6.3 | 71 | 2.4 | 2.4 | 2.5 | 1.06 | 1.06 |
| 20 (Comparison) | 5.1 | 5.9 | 73 | 3.0 | 3.0 | 2.6 | 1.05 | 1.05 |
| 21 (Comparison) | 5.0 | 5.7 | 71 | 3.2 | 3.2 | 2.6 | 1.05 | 1.06 |
| 22 (Invention) | 3.0 | 3.7 | 89 | 5.0 | 5.0 | 5.0 | 1.01 | 1.02 |
| 23 (Invention) | 2.5 | 3.2 | 74 | 5.8 | 5.8 | 3.0 | 1.03 | 1.03 |
| 24 (Invention) | 2.3 | 3.0 | 92 | 5.8 | 5.8 | 5.3 | 1.01 | 1.01 |

* The addition amount was adjusted so that the magenta density was equivalent to that of D-34 added to the 3$^{rd}$ layer to 5$^{th}$ layer in Experiment No. 4.

γY, γM and γY show the gradations of yellow, magenta and cyan respectively in the characteristic curve.

The contents of color development processing used in the development process of samples are as follows.

| Processing | Temperature (° C.) | Time |
|---|---|---|
| (1) Prebath | 27 ± 1 | 10 sec |
| (2) Elimination of backing and spray washing | 27–38 | 5 sec |
| (3) Color development | 41.1 ± 0.1 | 3 min |
| (4) Stopping | 27–38 | 30 sec |
| (5) Water washing | 27–38 | 30 sec |
| (6) Bleaching | 27 ± 1 | 3 min |
| (7) Water washing | 27–38 | 1 min |
| (8) Fixing | 38 ± 1 | 2 min |
| (9) Water washing | 27–38 | 2 min |
| (10) Stabilization | 27–38 | 10 sec |

The prescriptions of the processing solutions used in the processing steps are as follows.

Prescription of each processing solution:

| | Prescription |
|---|---|
| (1) Prebath | |
| Water at 27 to 38° C. | 800 ml |
| Borax (decahydrate) | 20.0 g |
| Sodium sulfate (anhydrous) | 100 g |
| Sodium hydroxide | 1.0 g |
| Water to make | 1.00 liter |
| pH (at 27° C.) | 9.25 |
| (3) Color development | |
| Water at 21 to 38° C. | 850 ml |
| Kodak Anticalcium No. 4 | 2.0 ml |
| Sodium sulfite (anhydrous) | 2.0 g |
| Eastman Antifog AF-2000 | 5.0 ml |
| Sodium bromide (anhydrous) | 1.20 g |
| Sodium carbonate (anhydrous) | 25.6 g |
| Sodium bicarbonate | 2.7 g |
| Color developing reagent 4-Amino-3-methyl-N-ethyl-N-(β-methane-sulfonamidoethyl)-aniline | 4.0 g |
| Water to make | 1.00 liter |
| pH (at 27° C.) | 10.20 |
| (4) Stopping | |
| Water at 21 to 38° C. | 900 ml |
| 7.0 N sulfuric acid | 50 ml |
| Water to make | 1.00 liter |
| pH (at 27° C.) | 0.9 |
| (6) Bleaching | |
| Water at 24 to 38° C. | 700 ml |
| Proxel GXL | 0.07 ml |
| Kodak Chelating Agent No. 1 | 24.2 g |
| 28% Ammonium hydroxide | 30.0 ml |
| Ammonium bromide | 32.5 g |
| Glacial acetic acid | 10.0 ml |
| Ferric nitrate (nonahydrate) | 28.8 g |
| Water to make | 1.0 liter |
| pH (at 27° C.) | 5.0 ± 0.2 |
| (8) Fixing | |
| Water at 20 to 38° C. | 700 ml |
| Kodak Anticalcium No. 4 | 2.0 ml |
| A 58% ammonium thiosulfate solution | 185 ml |
| Sodium sulfite (anhydrous) | 10.0 g |
| Sodium bisulfite (anhydrous) | 8.4 g |
| Water to make | 1.0 liter |
| pH (at 27° C.) | 6.5 |

-continued

Prescription of each processing solution:

| | Prescription |
|---|---|
| (10) Stabilization | |
| Water at 21 to 27° C. | 1.00 liter |
| Kodak Stabilizer Additive | 0.14 ml |
| Formaldehyde (a 37.5% solution) | 1.5 ml |

Functional Evaluation:

The functional evaluations of the image quality of Samples 301 to 312 were carried out as follows.

The image of a landscape having digital data of pixels of (2,048×1,556) was exposed on Samples 301 to 312 in the size of 0.8×0.6 inches with B, G, R lasers, and the obtained negative images were screened and appreciated by twenty panelists. Evaluation was performed by relative evaluation with the evaluation value of the time using Sample 301 being 3 (standard). Further, the negative images were exposed on Fuji Color Positive Film F-CP, and development processed according to the method described in FUJI FILM PROCESSING MANUAL, Motion Picture Films to obtain positive images. The obtained images were screened and evaluated in the same manner as above.

Sharpness was evaluated as to the negative images, and sharpness and color saturation as to the positive images by the following seven grades, and the values of evaluation by twenty panelists were averaged. The results obtained are shown in Table C, 0: Very inferior 1: Inferior 2: A little inferior 3: Standard 4: A little superior 5: Superior 6: Very superior Evaluation of Sensitivity:

Gray sensitometric exposure was performed with red, green and blue lasers, and after the above development process, magenta density was measured. The magenta density measured was the density of Dmin+0.5.

Evaluation of Processability:

After exposure and development process in the same manner as above, yellow density, magenta density and cyan density were measured and the conditions of sensitometry of each sample were obtained. In the next place, after performing exposure on the same conditions as the sensitometry, development process and measurement of density were carried out except that the prescription of the color development of the above development process was changed as follows, and the conditions of sensitometry of each sample were obtained.

The processability is evaluated by whether the values of γC/γM and γY/γM are near to 1 or not. That is, the nearer the value to 1, the better is the color balance, the less is the fluctuation by development processing, and the less is the deterioration after processing.

| (3) Color development | Prescription |
|---|---|
| Water at 21 to 38° C. | 850 ml |
| Kodak Anticalcium No. 4 | 2.0 ml |
| Sodium sulfite (anhydrous) | 1.7 g |
| Eastman Antifog AF-2000 | 5.0 ml |
| Sodium bromide (anhydrous) | 1.10 g |
| Sodium carbonate (anhydrous) | 25.6 g |
| Sodium bicarbonate | 2.7 g |
| Color developing reagent | |
| 4-Amino-3-methyl-N-ethyl-N-(β-methane-sulfonamidoethyl)-aniline | 3.7 g |
| Water to make | 1.00 liter |
| pH (at 27° C.) | 10.10 |

From the gradation of each color (the gradient of the characteristic curve) at the quantity of light of exposure amount+1.3 log E providing the density of Dmin+0.2 of the magenta characteristic curve, the ratio of yellow gradation to magenta gradation (γY/γM) and the ratio of cyan gradation to magenta gradation (γC/γM) were found, and deviation of the tint of image due to fluctuation of the processing solution was evaluated.

From the results shown in Table C, it can be seen that motion picture images little in sensitivity fluctuation and excellent in sharpness and color saturation can be obtained by adopting the image-recording method of the invention, using the fixed magenta dyes of the invention, and using silver halide emulsions having a particle size (an average equivalent-sphere diameter) of 0.35 μm or smaller.

Example 4

In the sample in Example 3, 0.005 g/m$^2$ of fixed cyan dye D-11 was added to the 6$^{th}$ layer, and the evaluation was carried out in the same manner as in Example 3. The results obtained are shown in Table D below. The same effects as in Example 3 were observed and blotting of red and color purity were conspicuously improved.

TABLE D

| | | | Magenta Dye | | | Cyan Dye | | |
|---|---|---|---|---|---|---|---|---|
| Experiment No. | Sample No. | Emulsion in Ninth Layer | Addition Layer | Dye | Addition Amount (g/m$^2$) | Addition Layer | Dye | Addition Amount (g/m$^2$) |
| 1 (Comparison) | 401 | Em-M | — | — | — | — | — | — |
| 2 (Comparison) | 402 | Em-M | — | — | — | 4$^{th}$ layer | D-11 | 0.005 |
| 3 (Invention) | 403 | Em-M | — | — | — | 6$^{th}$ layer | D-11 | 0.005 |
| 4 (Invention) | 404 | Em-M | 3$^{rd}$ layer | D-34 | 0.010 | — | — | — |
| | | | 4$^{th}$ layer | D-34 | 0.003 | | | |
| | | | 5$^{th}$ layer | D-34 | 0.022 | | | |
| | | | 6$^{th}$ layer | D-8 | 0.032 | | | |
| | | | 10$^{th}$ layer | D-8 | 0.028 | | | |
| | | | 12$^{th}$ layer | D-34 | 0.009 | | | |
| | | | 13$^{th}$ layer | D-34 | 0.003 | | | |
| 5 (Invention) | 405 | Em-M | 3$^{rd}$ layer | D-34 | 0.010 | 4$^{th}$ layer | D-11 | 0.005 |
| | | | 4$^{th}$ layer | D-34 | 0.003 | | | |
| | | | 5$^{th}$ layer | D-34 | 0.022 | | | |
| | | | 6$^{th}$ layer | D-8 | 0.032 | | | |
| | | | 10$^{th}$ layer | D-8 | 0.028 | | | |
| | | | 12$^{th}$ layer | D-34 | 0.009 | | | |
| | | | 13$^{th}$ layer | D-34 | 0.003 | | | |
| 6 (Invention) | 406 | Em-M | 3$^{rd}$ layer | D-34 | 0.010 | 6$^{th}$ layer | D-11 | 0.005 |
| | | | 4$^{th}$ layer | D-34 | 0.003 | | | |
| | | | 5$^{th}$ layer | D-34 | 0.022 | | | |
| | | | 6$^{th}$ layer | D-8 | 0.032 | | | |
| | | | 10$^{th}$ layer | D-8 | 0.028 | | | |
| | | | 12$^{th}$ layer | D-34 | 0.009 | | | |
| | | | 13$^{th}$ layer | D-34 | 0.003 | | | |

| | Blotting of Green [k/(D − 0.2)$^2$] | | Color Purity of Green (Dmax) | Blotting of Red [k/(D − 0.2)$^2$] | | Color Purity of Red (Dmax) | Functional Evaluation | | |
|---|---|---|---|---|---|---|---|---|---|
| | | | | | | | Sharpness | | |
| Experiment No. | Dmin + 1.0 | Dmin + 2.0 | (%) | Dmin + 1.0 | Dmin + 2.0 | (%) | Negative Image | Positive Image | Color Saturation |
| 1 (Comparison) | 5.2 | 5.7 | 74 | 6.5 | 7.4 | 70 | 3.0 | 3.0 | 3.0 |
| 2 (Comparison) | 5.1 | 5.7 | 75 | 6.4 | 7.4 | 71 | 3.1 | 3.2 | 3.1 |
| 3 (Invention) | 5.1 | 5.7 | 74 | 5.3 | 6.2 | 79 | 3.7 | 3.8 | 3.4 |
| 4 (Invention) | 4.5 | 4.8 | 77 | 6.4 | 7.4 | 72 | 3.9 | 3.8 | 3.5 |
| 5 (Invention) | 4.4 | 4.9 | 78 | 6.5 | 7.2 | 71 | 3.8 | 3.7 | 3.3 |
| 6 (Invention) | 4.3 | 5.0 | 79 | 5.2 | 6.0 | 78 | 4.4 | 4.5 | 4.7 |

| | | | Magenta Dye | | | Cyan Dye | | |
|---|---|---|---|---|---|---|---|---|
| Experiment No. | Sample No. | Emulsion in Ninth Layer | Addition Layer | Dye | Addition Amount (g/m$^2$) | Addition Layer | Dye | Addition Amount (g/m$^2$) |
| 7 (Comparison) | 407 | Em-c | — | — | — | — | — | — |
| 8 (Comparison) | 408 | Em-c | — | — | — | 4$^{th}$ layer | D-11 | 0.005 |
| 9 (Invention) | 409 | Em-c | — | — | — | 6$^{th}$ layer | D-11 | 0.005 |

TABLE D-continued

| | | | | | | | | |
|---|---|---|---|---|---|---|---|---|
| 10 (Invention) | 410 | Em-c | 3rd layer | D-34 | 0.010 | — | — | — |
| | | | 4th layer | D-34 | 0.003 | | | |
| | | | 5th layer | D-34 | 0.022 | | | |
| | | | 6th layer | D-8 | 0.032 | | | |
| | | | 10th layer | D-8 | 0.028 | | | |
| | | | 12th layer | D-34 | 0.009 | | | |
| | | | 13th layer | D-34 | 0.003 | | | |
| 11 (Invention) | 411 | Em-c | 3rd layer | D-34 | 0.010 | 4th layer | D-11 | 0.005 |
| | | | 4th layer | D-34 | 0.003 | | | |
| | | | 5th layer | D-34 | 0.022 | | | |
| | | | 6th layer | D-8 | 0.032 | | | |
| | | | 10th layer | D-8 | 0.028 | | | |
| | | | 12th layer | D-34 | 0.009 | | | |
| | | | 13th layer | D-34 | 0.003 | | | |
| 12 (Invention) | 412 | Em-c | 3rd layer | D-34 | 0.010 | 6th layer | D-11 | 0.005 |
| | | | 4th layer | D-34 | 0.003 | | | |
| | | | 5th layer | D-34 | 0.022 | | | |
| | | | 6th layer | D-8 | 0.032 | | | |
| | | | 10th layer | D-8 | 0.028 | | | |
| | | | 12th layer | D-34 | 0.009 | | | |
| | | | 13th layer | D-34 | 0.003 | | | |

| | Blotting of Green [k/(D − 0.2)$^2$] | | Color Purity of Green (Dmax) | Blotting of Red [k/(D − 0.2)$^2$] | | Color Purity of Red (Dmax) | Functional Evaluation Sharpness | | |
|---|---|---|---|---|---|---|---|---|---|
| Experiment No. | Dmin + 1.0 | Dmin + 2.0 | (%) | Dmin + 1.0 | Dmin + 2.0 | (%) | Negative Image | Positive Image | Color Saturation |
| 7 (Comparison) | 5.6 | 6.3 | 70 | 6.9 | 7.8 | 71 | 2.6 | 2.5 | 2.7 |
| 8 (Comparison) | 5.5 | 6.2 | 71 | 6.9 | 7.7 | 70 | 2.8 | 2.5 | 2.6 |
| 9 (Invention) | 5.6 | 6.3 | 70 | 3.2 | 4.3 | 87 | 5.1 | 4.9 | 5.2 |
| 10 (Invention) | 2.3 | 3.0 | 92 | 6.7 | 7.7 | 73 | 5.2 | 5.1 | 5.1 |
| 11 (Invention) | 2.2 | 2.8 | 93 | 6.6 | 7.8 | 72 | 5.3 | 5.2 | 5.0 |
| 12 (Invention) | 2.3 | 2.9 | 92 | 3.1 | 4.1 | 88 | 5.8 | 5.9 | 5.6 |

Example 5

When evaluation was performed in the same manner as in Example 3 by replacing dye D-8 in Example 3 with D-9 and D-34 with D-35, almost the same effect as in Example 3 was obtained, although D-9 and D-35 were a little inferior to D-8 and D-34 respectively.

The entire disclosure of each and every foreign patent application from which the benefit of foreign priority has been claimed in the present application is incorporated herein by reference, as if fully set forth.

What is claimed is:

1. A silver halide photographic material, which comprises:

a transparent support; and a plurality of layers comprising a first layer, a second layer and a third layer on the transparent support, wherein the first layer consists of at least one blue-sensitive silver halide emulsion layer, the second layer consists of at least one green-sensitive silver halide emulsion layer and the third layer consists of at least one red-sensitive silver halide emulsion layer, wherein the silver halide photographic material comprises at least one layer containing a fixed magenta dye which is located as at least one of: a layer on the opposite side to the transparent support with the at least one green-sensitive silver halide emulsion layer as a center and not the at least one green-sensitive silver halide emulsion layer; and a layer on the side of the transparent support with the at least one green-sensitive silver halide emulsion layer as a center and not the at least one green-sensitive silver halide emulsion layer, and wherein all silver halide emulsions in the at least one green-sensitive silver halide emulsion layer are emulsions comprising silver halide grains having an average equivalent-sphere diameter of 0.35 μm or smaller.

2. A silver halide photographic material, which comprises:

a transparent support; and a plurality of layers comprising a first layer, a second layer and a third layer on the transparent support, wherein the first layer consists of at least one blue-sensitive silver halide emulsion layer, the second layer consists of at least one green-sensitive silver halide emulsion layer and the third layer consists of at least one red-sensitive silver halide emulsion layer, wherein the silver halide photographic material comprises at least one layer containing a fixed cyan dye which is located as a layer on the opposite side to the transparent support with the at least one red-sensitive silver halide emulsion layer as a center and not the at least one red-sensitive silver halide emulsion layer, and wherein all silver halide emulsions in the at least one red-sensitive silver halide emulsion layer are emulsions comprising silver halide grains having an average equivalent-sphere diameter of 0.35 μm or smaller.

3. The silver halide photographic material according to claim 2, wherein the silver halide photographic material comprises at least one layer containing a fixed magenta dye which is located as at least one of: a layer on the opposite side to the transparent support with the at least one green-sensitive silver halide emulsion layer as a center and not the at least one green-sensitive silver halide emulsion layer; and a layer on the side of the transparent support with the at least one green-sensitive silver halide emulsion layer as a center and not the at least one green-sensitive silver halide emulsion layer.

4. The silver halide photographic material according to claim 1, wherein at a time of recording a digital image data in resolution of 2,000 dpi or more, the digital image data can be recorded with little deterioration.

5. The silver halide photographic material according to claim 1, wherein a digital image data of 3,000,000 pixels or more can be recorded with little deterioration.

6. The silver halide photographic material according to claim 4, wherein blotting k of an image based on the digital image data recorded at the image recording satisfies expression (I):

$$k \leqq 7.5\ \mu m \times (D-0.2)^2 \quad \text{(I)}$$

wherein D is a coloring density of the silver halide photographic material; and blotting k is a blotting (μm) in a coloring density D.

7. The silver halide photographic material according to claim 4, wherein blotting k of an image based on the digital image data recorded at the image recording satisfies expression (I-4):

$$k \leqq 4.5\ \mu m \times (D-0.2)^2 \quad \text{(I-4)}$$

wherein D is a coloring density of the silver halide photographic material; and blotting k is a blotting (μm) in a coloring density D.

8. The silver halide photographic material according to claim 4, wherein a color purity rate in color reproduction of an image based on the digital image data recorded at the image recording is 80% or more.

9. An image-forming method, which comprises: recording a digital image data which is recorded on a silver halide photographic material according to claim 1 on another silver halide photographic material by an analog method.

* * * * *